US011067946B2

(12) United States Patent
Endo

(10) Patent No.: US 11,067,946 B2
(45) Date of Patent: Jul. 20, 2021

(54) REMOVABLY MOUNTABLE UNIT AND IMAGE FORMING APPARATUS

(71) Applicant: CANON KABUSHIKI KAISHA, Tokyo (JP)

(72) Inventor: Atsushi Endo, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/067,957

(22) Filed: Oct. 12, 2020

(65) Prior Publication Data

US 2021/0116855 A1 Apr. 22, 2021

(30) Foreign Application Priority Data

Oct. 17, 2019 (JP) ..... JP2019-190612

(51) Int. Cl.
*G03G 15/00* (2006.01)
*G03G 21/18* (2006.01)
*G03G 15/08* (2006.01)

(52) U.S. Cl.
CPC ..... *G03G 21/1814* (2013.01); *G03G 15/0886* (2013.01); *G03G 21/1832* (2013.01); *G03G 21/1842* (2013.01)

(58) Field of Classification Search
CPC ..... G03G 15/0877; G03G 15/0886; G03G 21/1814; G03G 21/1832; G03G 21/1842
See application file for complete search history.

(56) References Cited

U.S. PATENT DOCUMENTS 7,486,910 B2 * 2/2009 Kitozaki ..... G03G 21/105 399/110
2014/0376972 A1 12/2014 Kawarago
2016/0109827 A1 * 4/2016 Yoshida ..... G03G 21/1821 399/260
2017/0285529 A1 10/2017 Nishiyama

FOREIGN PATENT DOCUMENTS

JP H08-062979 A 3/1996
JP 2015-007707 A 1/2015
JP 2017-102165 A 6/2017
JP 2017-182009 A 10/2017

* cited by examiner

*Primary Examiner* — Hoang X Ngo
(74) *Attorney, Agent, or Firm* — Venable LLP

(57) ABSTRACT

A cartridge detachably mountable to an image forming apparatus includes a cleaning member; a cleaner container; a discharge opening; a shutter for the opening; an urging member for urging the shutter to a closing position, wherein when the cartridge is mounted, the shutter abuts to a shutter abutting portion provided in the image forming apparatus to be moved from a closing position to an opening position; a locking member rotatable between a locking position and a release position, wherein before the shutter contacts to the shutter abutting portion when mounting the cartridge to the apparatus, the locking member contacts a releasing portion provided in the apparatus to be rotated in a releasing direction, by the releasing portion; and an interrelating mechanism for interrelating relative movement between the shutter and the cleaner container and rotation of the locking member in a direction of the locking.

16 Claims, 16 Drawing Sheets

(a)

(b)

(a)

(b)

REMOVABLY MOUNTABLE UNIT AND IMAGE FORMING APPARATUS

FIELD OF THE INVENTION AND RELATED ART

The present invention relates to a cartridge which is removably installable in the main assembly of an image forming apparatus such a copying machine, a printer, a facsimileing machine, and the like, which uses an electrophotographic image forming method, or an electrostatic recording method. It also relates to an image forming apparatus in which a removably installable cartridge is removably installable.

Some conventional image forming apparatuses which use an electrophotographic image forming method, or the like, are structured so that a unit or the like which includes a photosensitive member is removably installable, as a consumable, in the main assembly of an image forming apparatus (which hereafter may be referred to as "apparatus main assembly"). Generally speaking, a unit which is removably installable in the apparatus main assembly is shorter in life expectancy than the apparatus main assembly. Further, the unit and apparatus main assembly are structured so that the former can be easily installed into, or uninstalled from, the latter. This type of unit is replaced periodically, for example, by a person who is in charge of service, or a user him- or herself.

Further, some removably installable units such as the one described above are provided with an opening which makes it possible for powdery substance to be transferred between the interior and exterior of the unit. For example, some units which include a photosensitive member are provided with a storage for the toner recovered from the photosensitive member, and an opening for connecting between the storage and a toner passage with which the apparatus main assembly is provided.

Generally speaking, a removably installable unit with an opening such as the one described above is structured so that its powdery substance transferring portion between the unit, and the toner passage, with which the apparatus main assembly is provided, is provided with a shutter which can be opened or closed. With the provision of the shutter, it is possible to prevent toner from leaking and/or scattering from the unit. Further, some removably installable units are provided with such a shutter as the one described above are provided with a locking mechanism for preventing the shutter from accidentally opening while a service personnel, a user, or the like is handling the unit.

There is proposed in Japanese Laid-open Patent Application No. H8-62979, a structural design for an image forming apparatus which is provided with the first shutter which belongs to a toner container and has an engaging portion, and the second shutter with which the apparatus main assembly is provided, and which also has an engaging portion. In the case of this structural design, as the above-mentioned two engaging portions engage with each other, the shutter is opened. Further, a guide which opens or closes the shutter is provided with a locking member. As a toner container is installed in the apparatus main assembly, a disengaging member with which the apparatus main assembly is provided disengages the locking member, allowing thereby the shutter to open.

Even in the case of the conventional design for an image forming apparatus, described above, as a removably installable unit is installed into the main assembly of the image forming apparatus, the lock of the shutter of the removably installable unit is disengaged by the unit. However, an operator has to operate the locking member to reengage the disengaged locking member after the removal of the unit out of the apparatus main assembly. That is, the operator has to carry out an additional job, besides the job of removing the unit out of the apparatus main assembly. Thus, a conventional design for an image forming apparatus which employs a removably installable unit is desired to be improved in terms of usability.

Thus, the primary object of the present invention is to provide an image forming apparatus which employs a removably installable unit having a shutter which opens or closes the opening of the unit, and a locking member for locking the shutter, and which is structured so that the locking member is made to rotationally move between the engaging position and disengaging position by the unit when the unit is installed into, or removed from, the main assembly of the image forming apparatus, and yet, is simple in structure.

SUMMARY OF THE INVENTION

According to an aspect of the present invention, there is provided a cartridge detachably mountable to a main assembly of an image forming apparatus, comprising an image bearing member configured to bear a toner image; a cleaning member configured to remove residual toner from said image bearing member; a cleaner container including accommodating portion configured to accommodate the toner removed by said cleaning member; a discharge opening configured to discharge the toner accommodated in said accommodating portion; a shutter movable between a closing position for closing said discharge opening and an opening position for opening said discharge opening; an urging member configured to urge said shutter to the closing position, wherein when said cartridge is mounted to the main assembly of said image forming apparatus, said shutter abuts to a shutter abutting portion provided in the main assembly of said image forming apparatus to be moved from the closing position to the opening position; a locking member rotatable between a locking position for preventing said shutter from moving from the closing position to the opening position and a release position for releasing said shutter from the locking, wherein before said shutter is brought into contact to the shutter abutting portion with a mounting operation of said cartridge to the main assembly of said apparatus, said locking member contacts a releasing portion provided in the main assembly of the image forming apparatus to be rotated in a direction of releasing the locking, by the releasing portion; and an interrelating mechanism configured to interrelate relative movement between said shutter and said cleaner container by an urging force of said urging member and rotation of said locking member in a direction of the locking.

Further features of the present invention will become apparent from the following description of exemplary embodiments with reference to the attached drawings.

Figure 2:
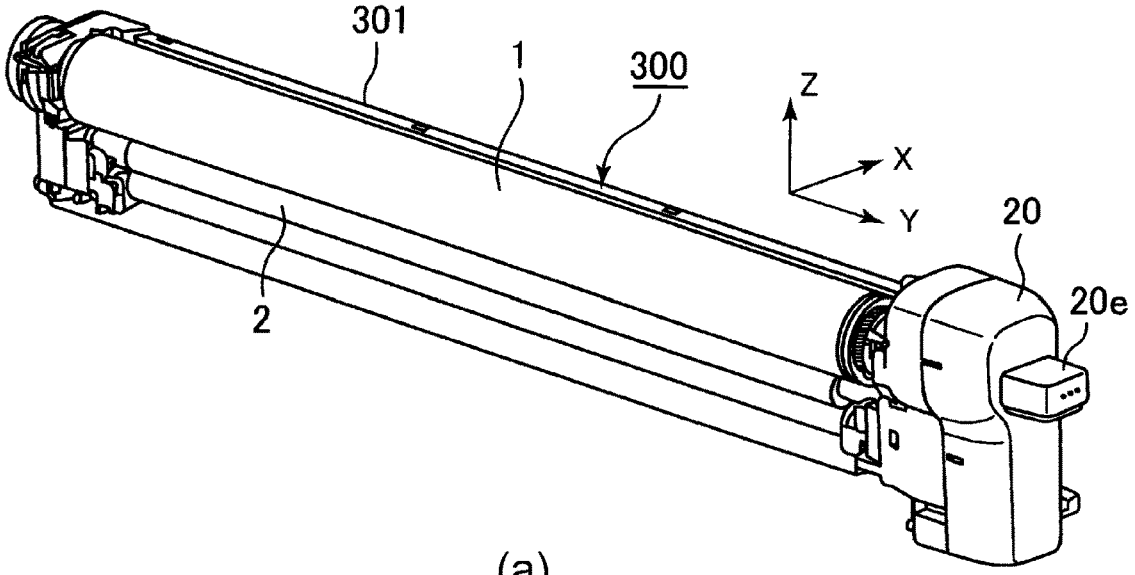
Figure 2:
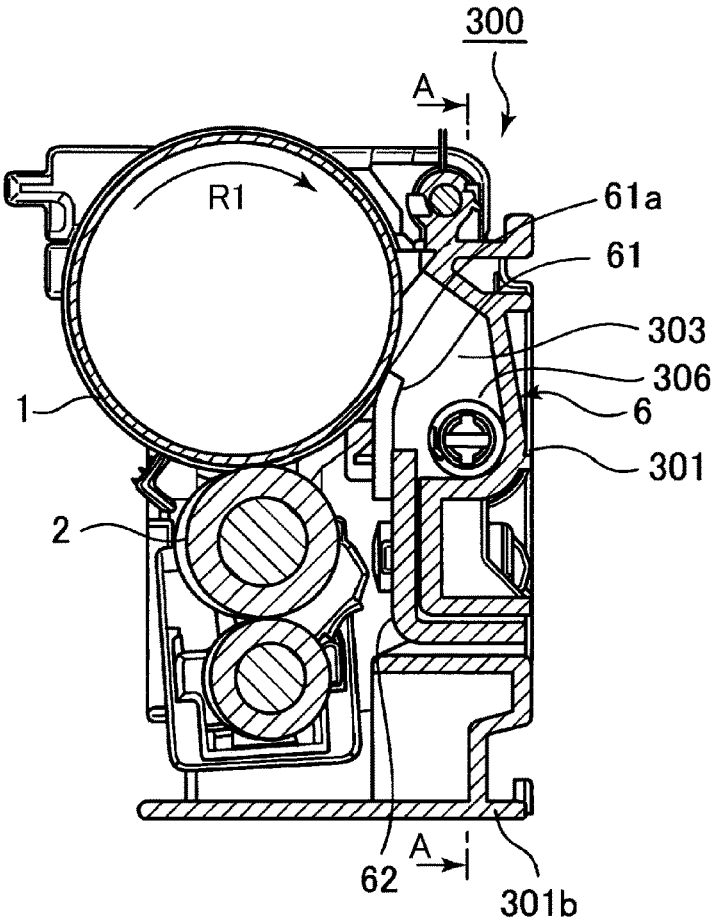

Parts (a) and (b) of FIG. 2 are a combination of an external perspective view of a drum cartridge, and a sectional view of the drum cartridge.

Figure 3:
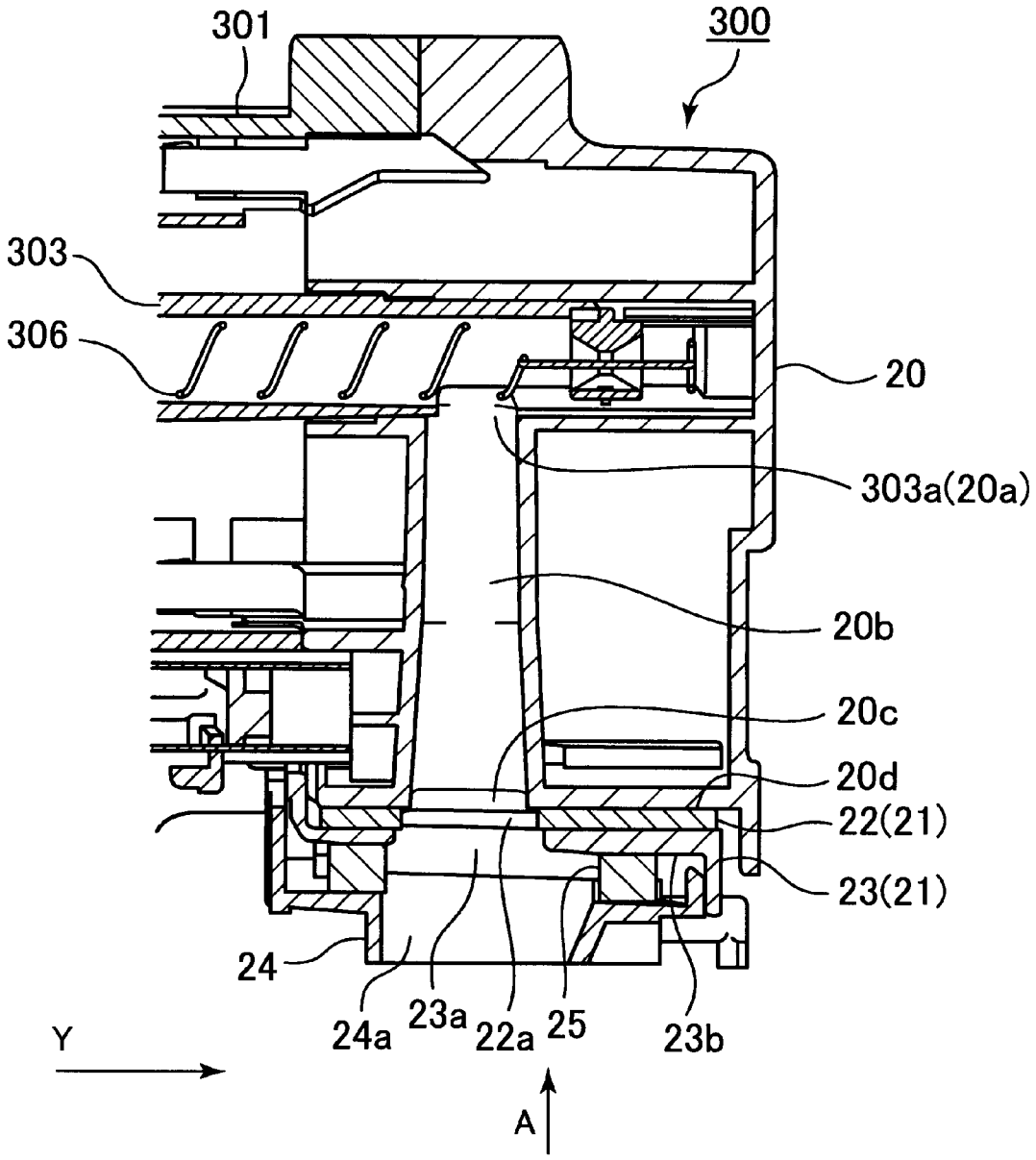

FIG. 3 is a sectional view of the adjacencies of the portion of the drum cartridge, in which a drum cartridge is in connection to the apparatus main assembly.

Figure 4:
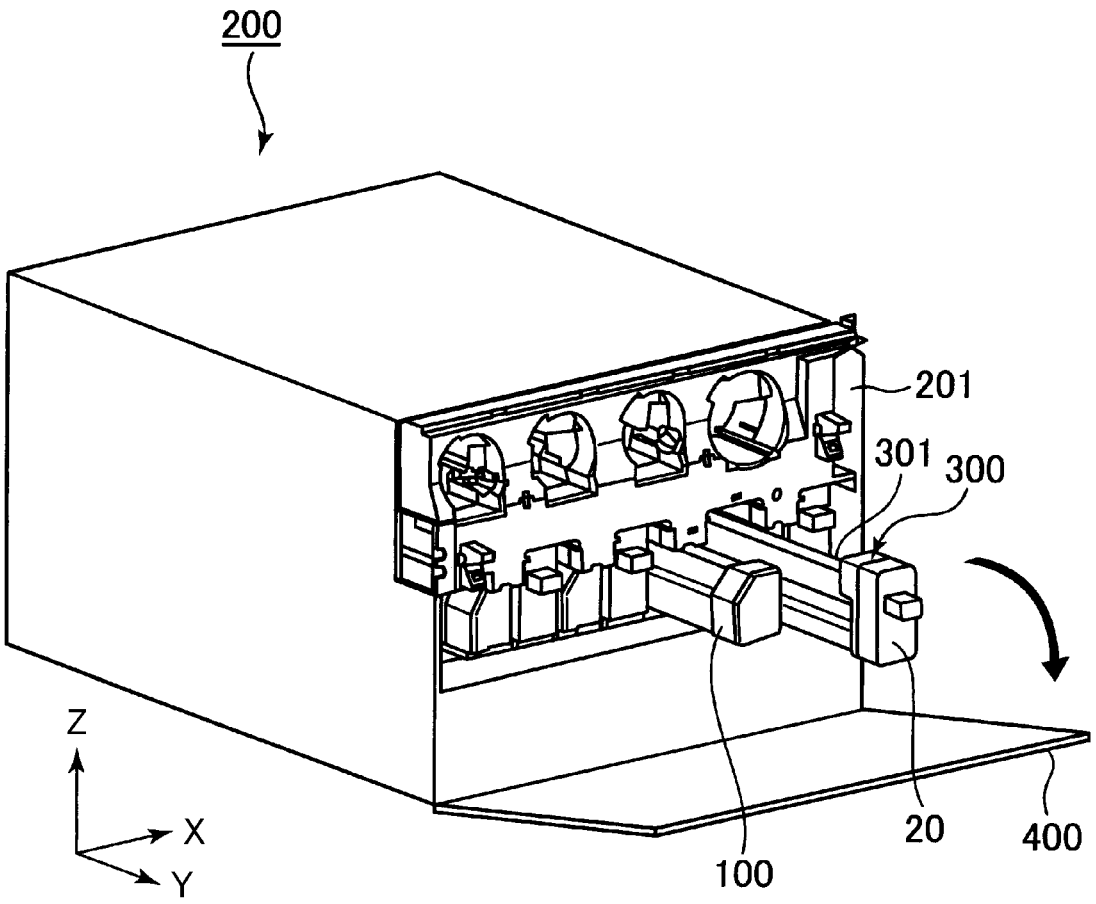

FIG. 4 is a schematic perspective view of the image forming apparatus when its front door is open; it is for showing the method for installing or uninstalling a drum cartridge, into or from, the apparatus main assembly.

Figure 5:
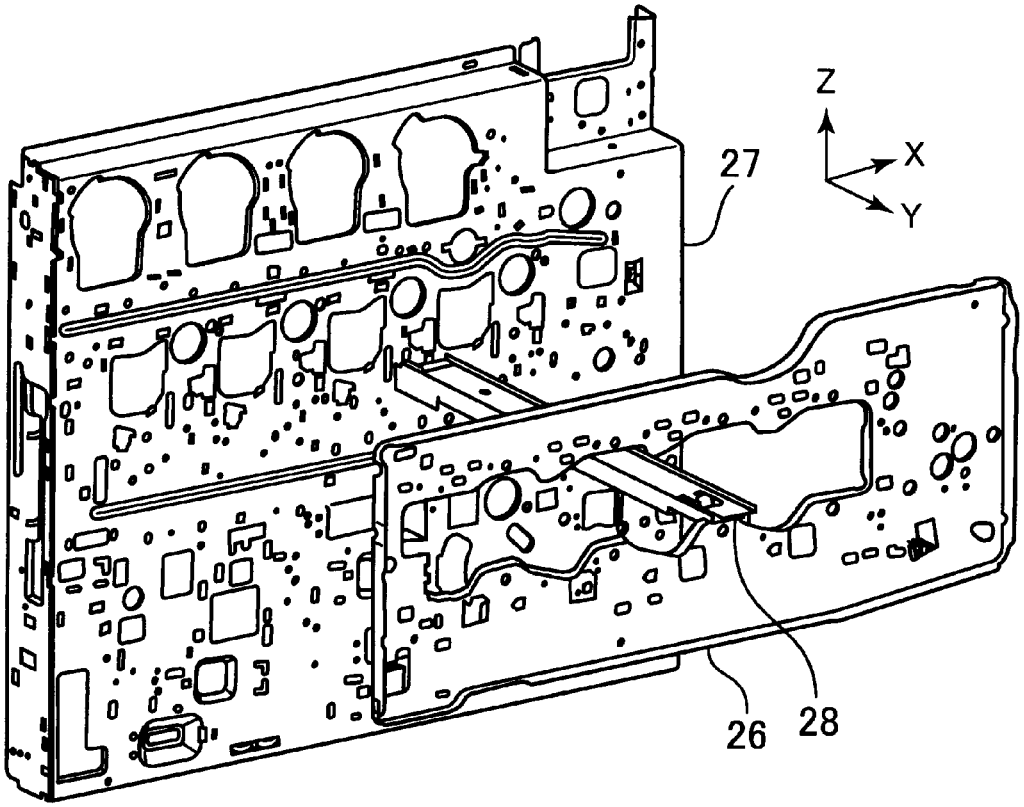

FIG. 5 is a perspective view of a combination of the front and rear plates and a guide rail of the main assembly of the image forming apparatus.

Figure 6:
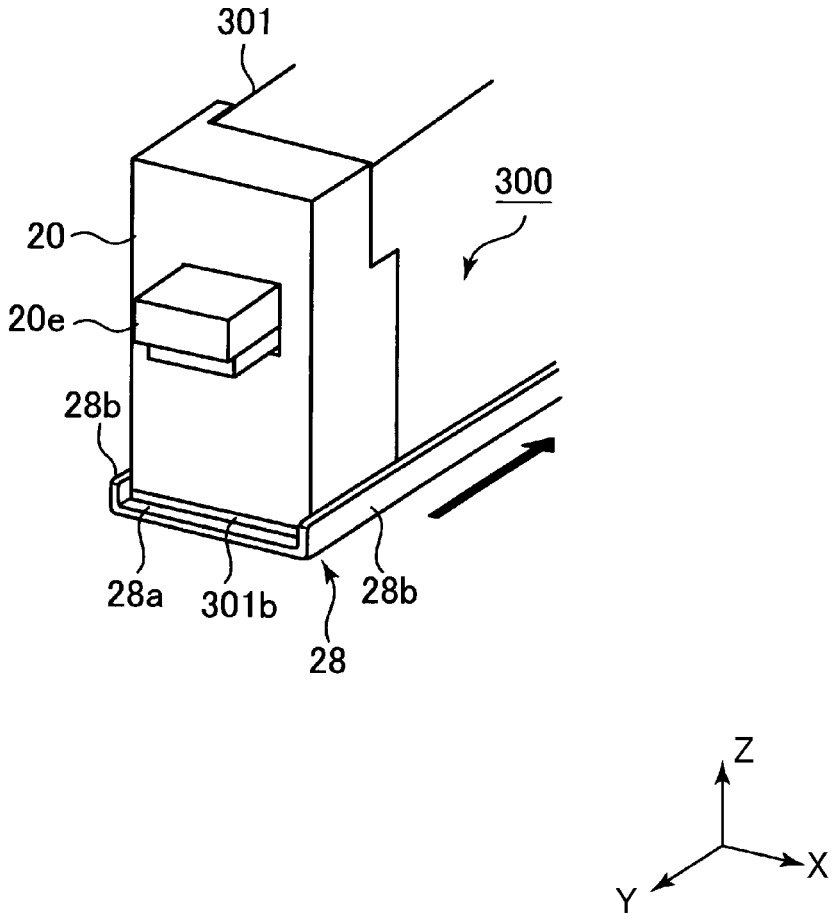
Figure 6:
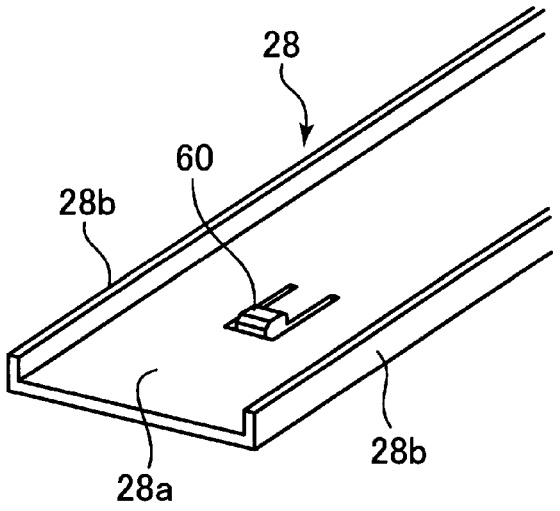

Parts (a) and (b) of FIG. 6 are schematic perspective views of the front end portion of a combination of a drum cartridge and a guide rail in terms of cartridge insertion direction.

Figure 7:
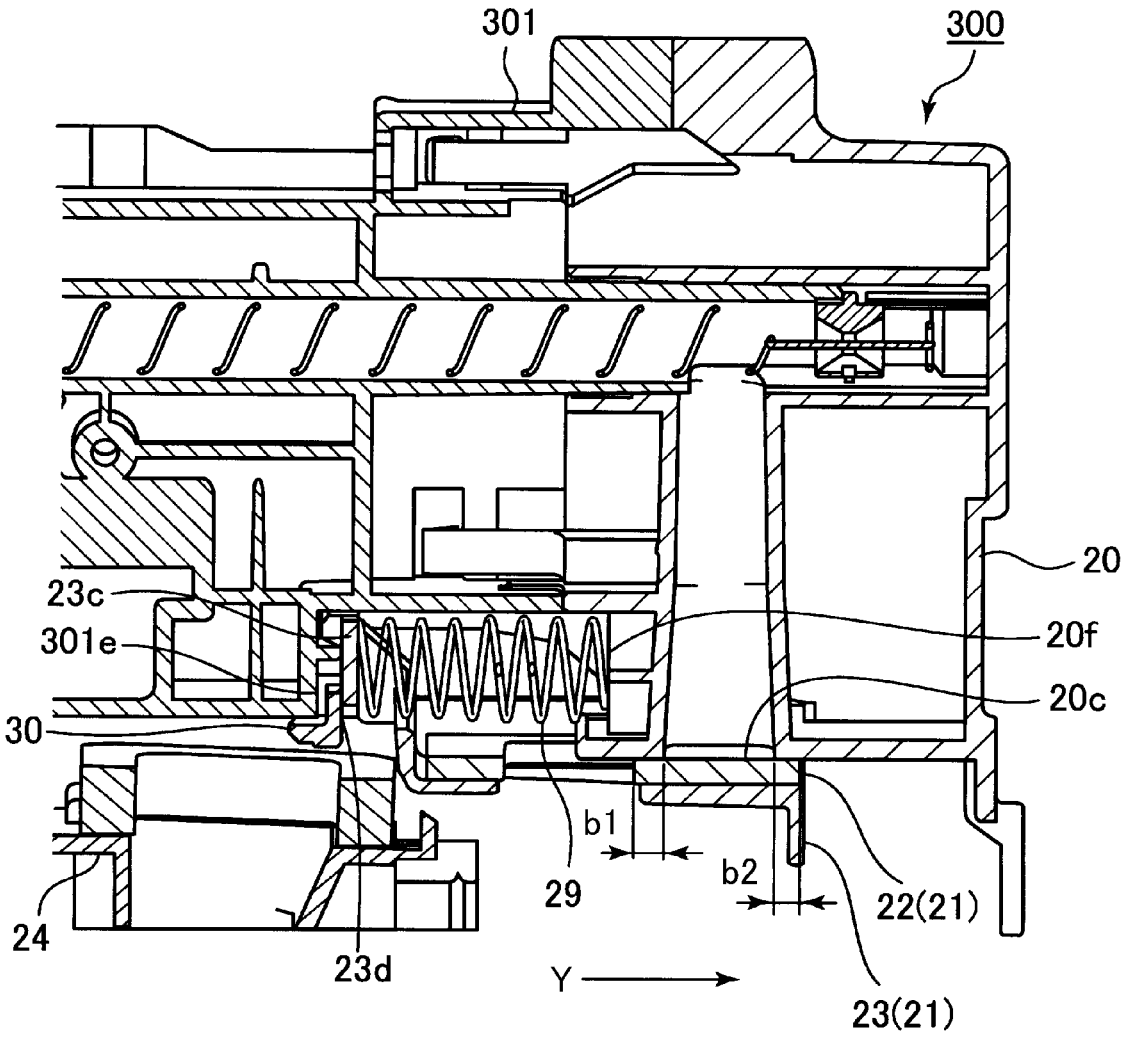

FIG. 7 is a sectional view of the adjacencies of the portion (closed) of the apparatus main assembly, in which a drum cartridge is in connection to the apparatus main assembly.

Figure 8:
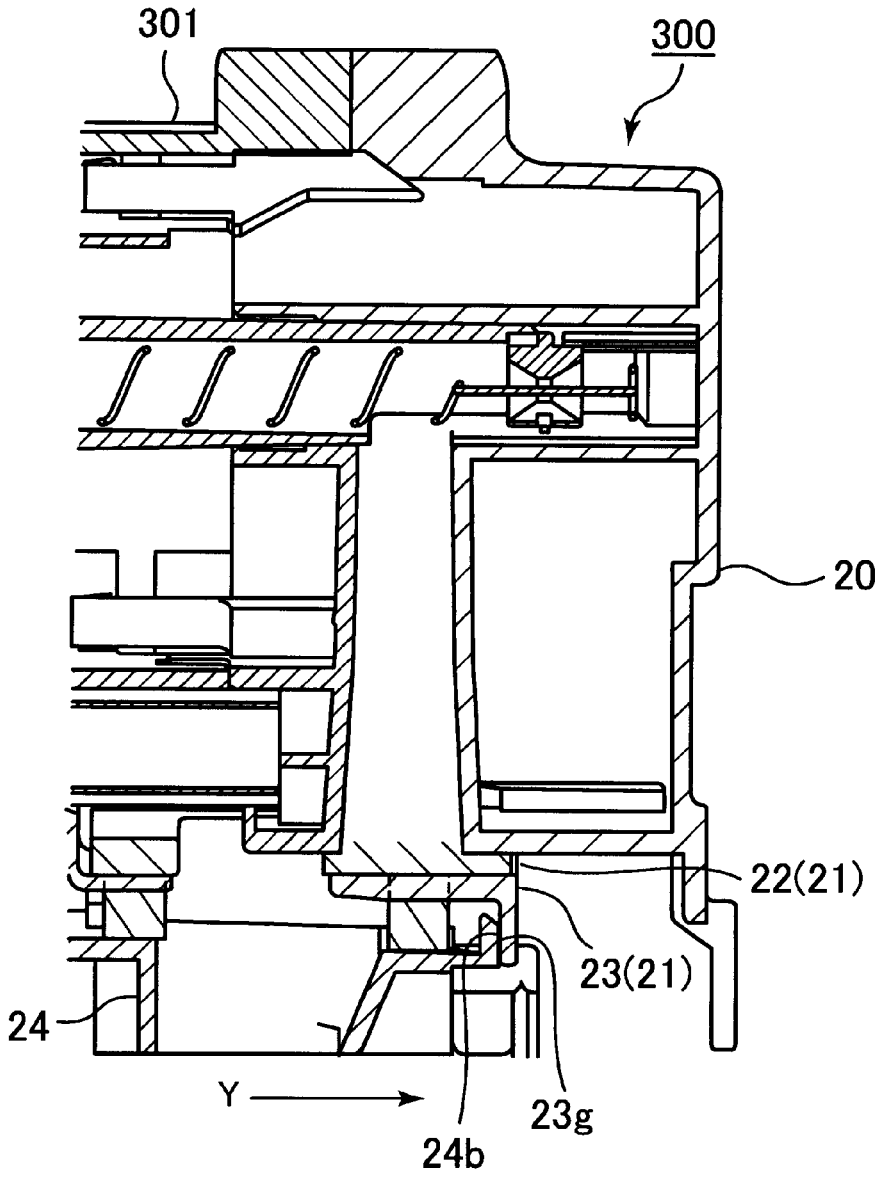

FIG. 8 is a sectional view of the adjacencies of the portion of the apparatus main assembly, in which a drum cartridge is in connection to the apparatus main assembly (when shutter began to be made to move).

Figure 9:
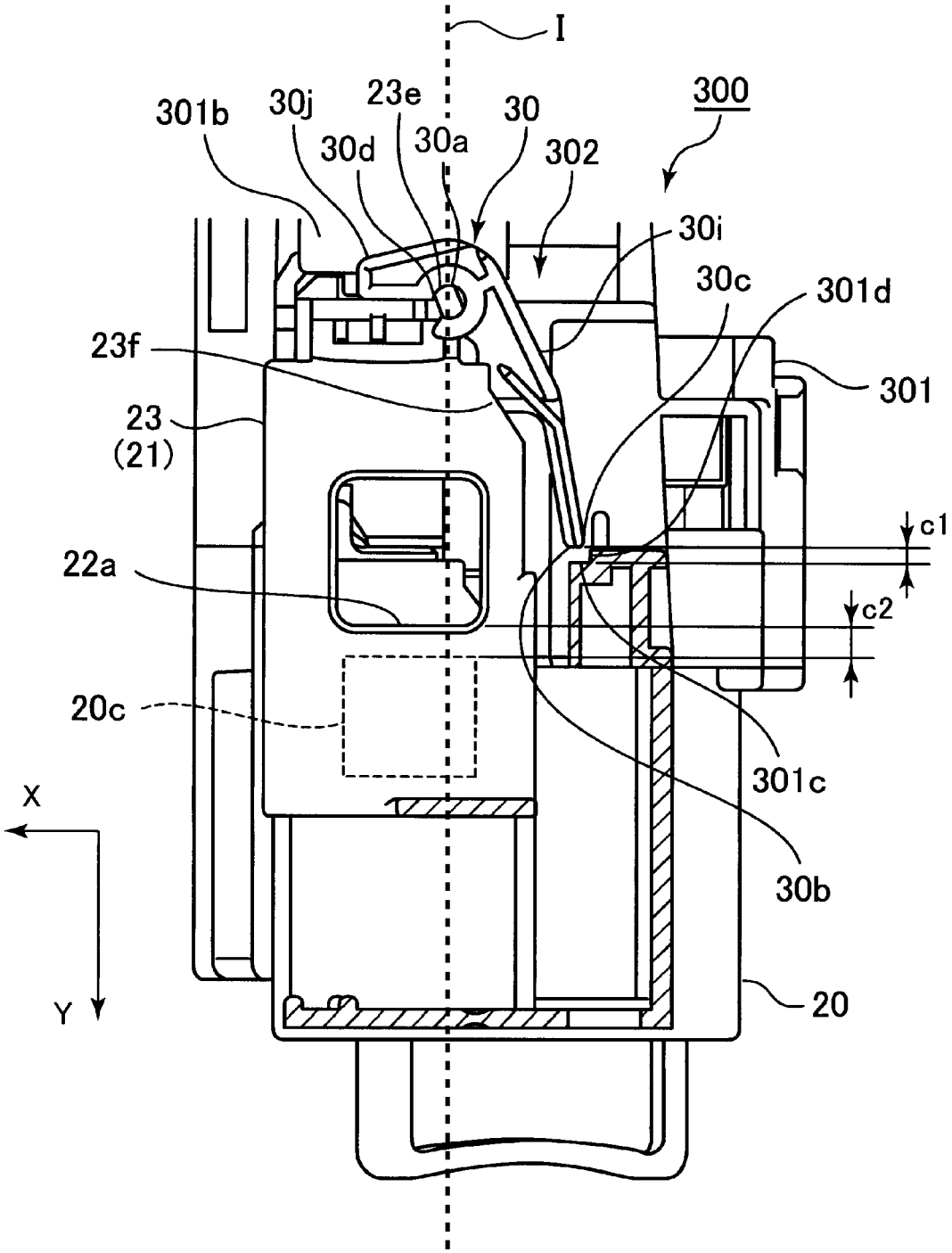

FIG. 9 is a sectional view of the drum cartridge when the locking member of the drum cartridge is in its engaging position.

Figure 10:
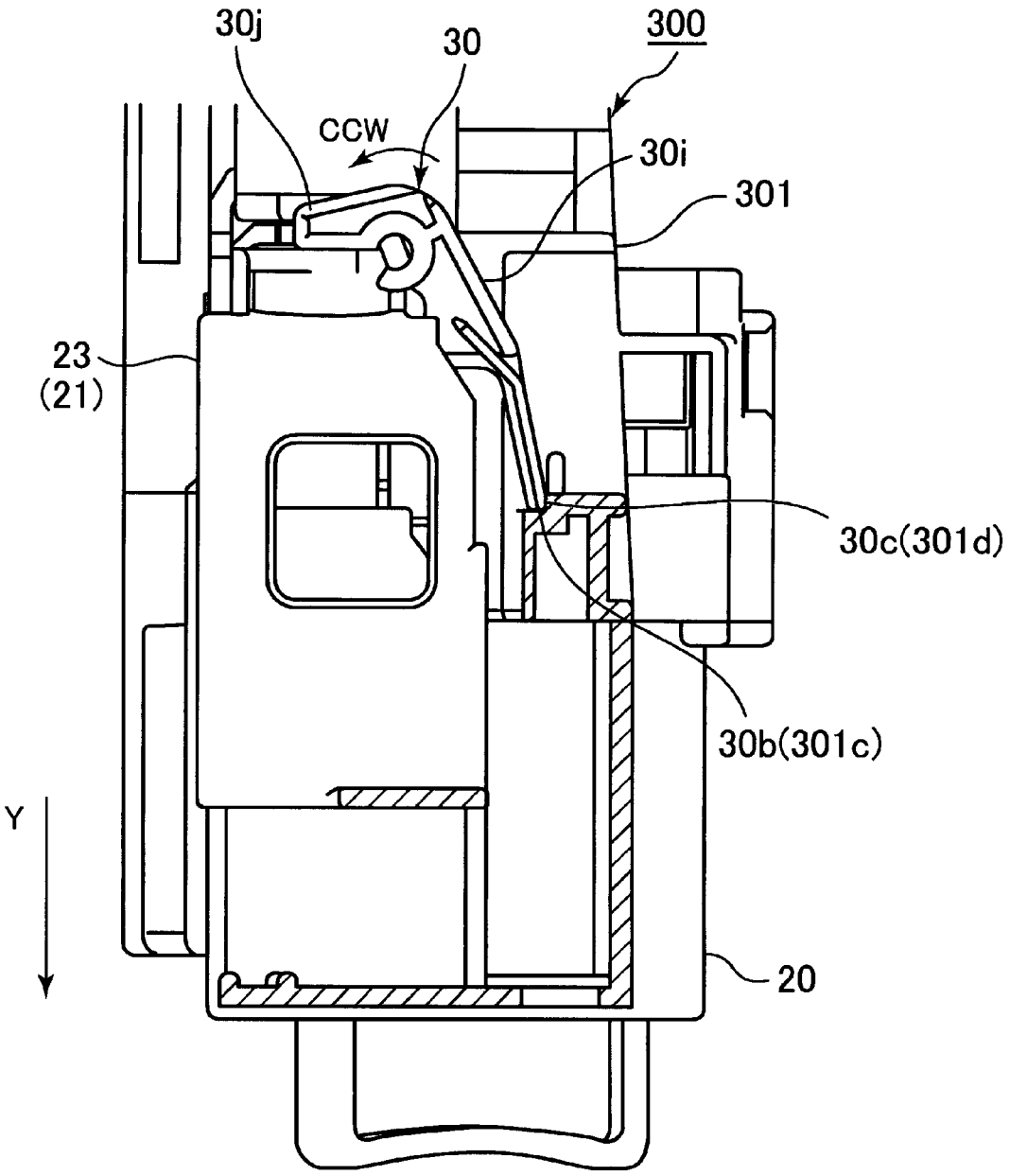

FIG. 10 is a sectional view of the drum cartridge when the locking member is remaining engaged.

Figure 11:
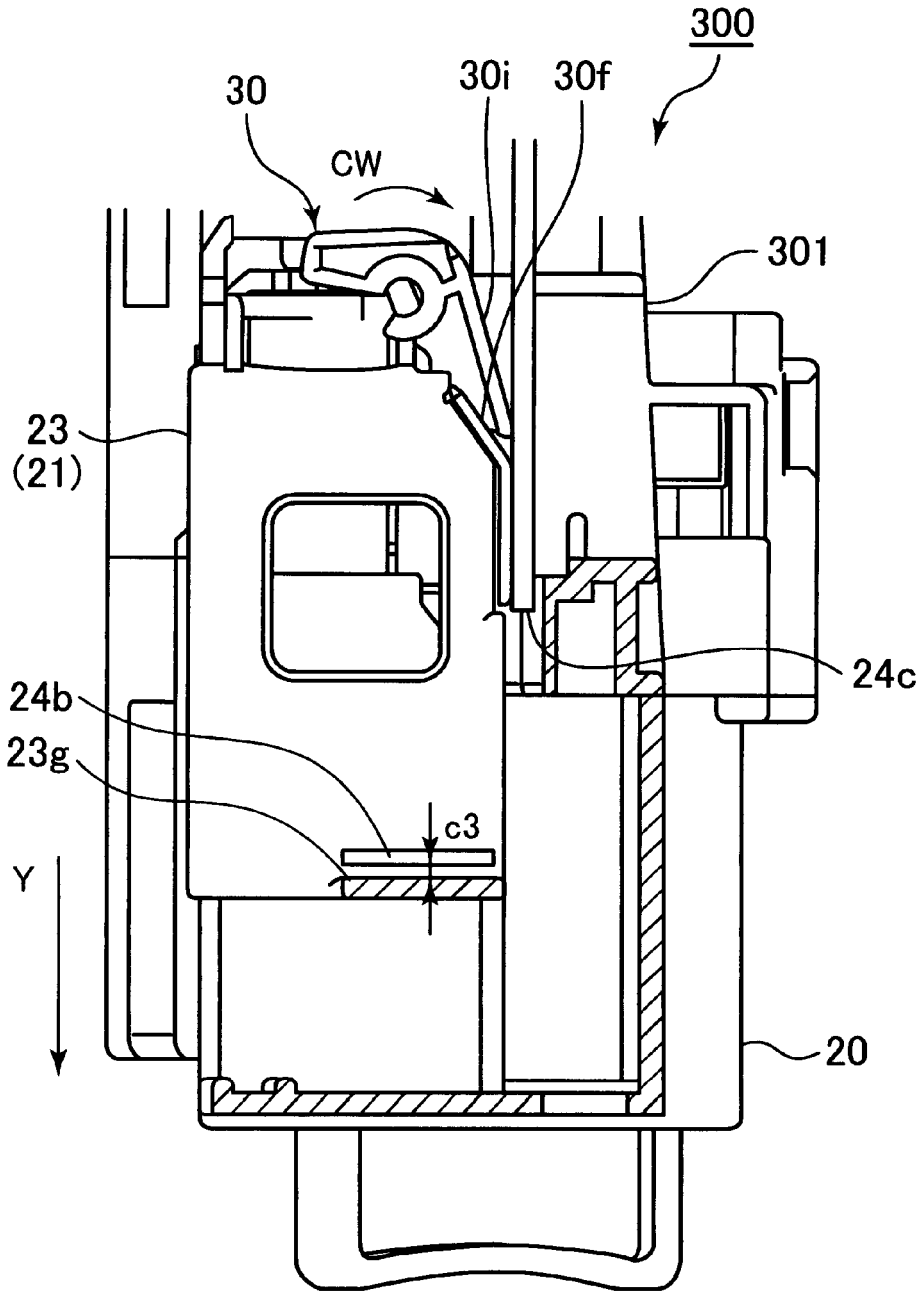

FIG. 11 is a sectional view of the drum cartridge when the locking member is in its disengaging position.

Figure 12:
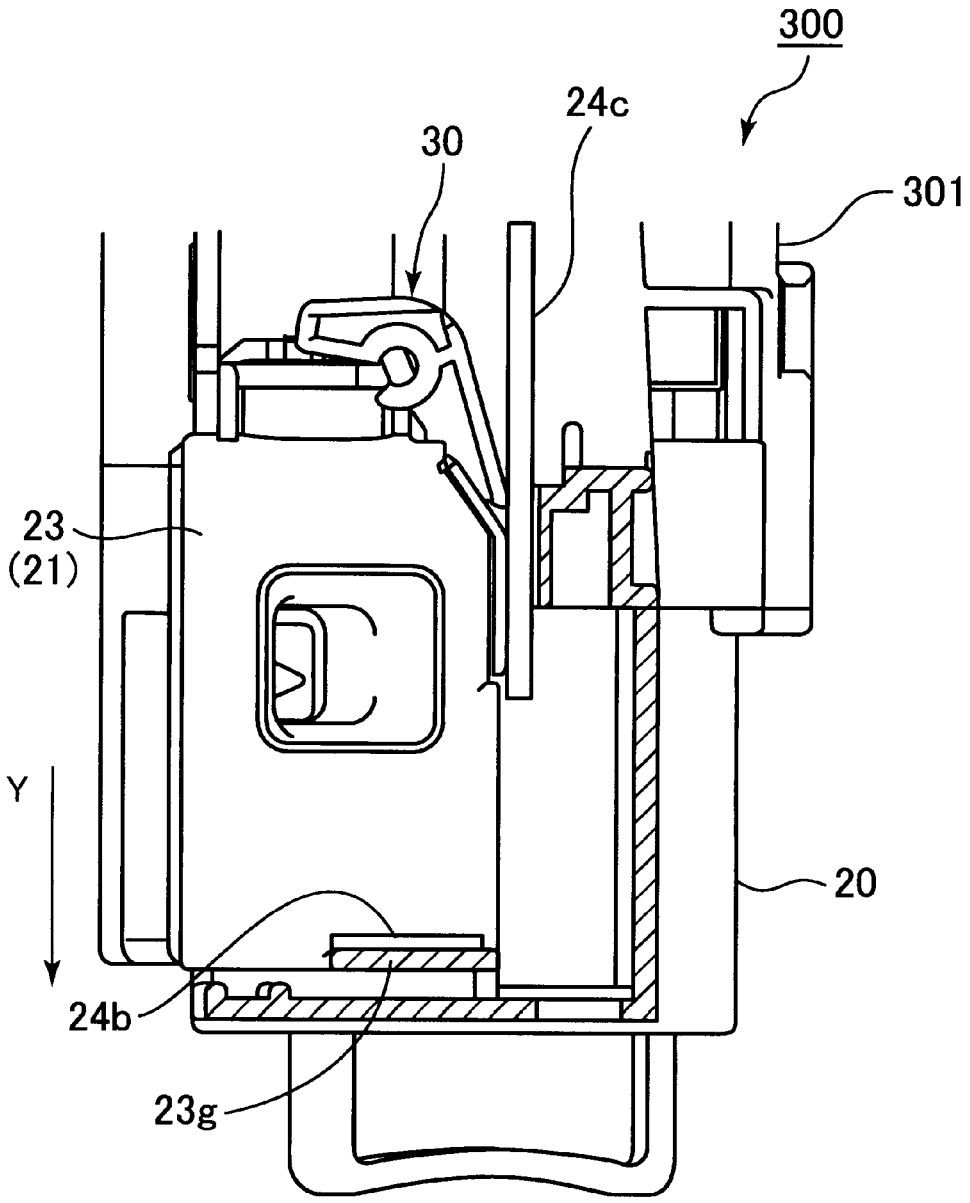

FIG. 12 is a sectional view of the drum cartridge, which shows the state in which locking member is after the completion of the installation of the drum cartridge.

Figure 13:
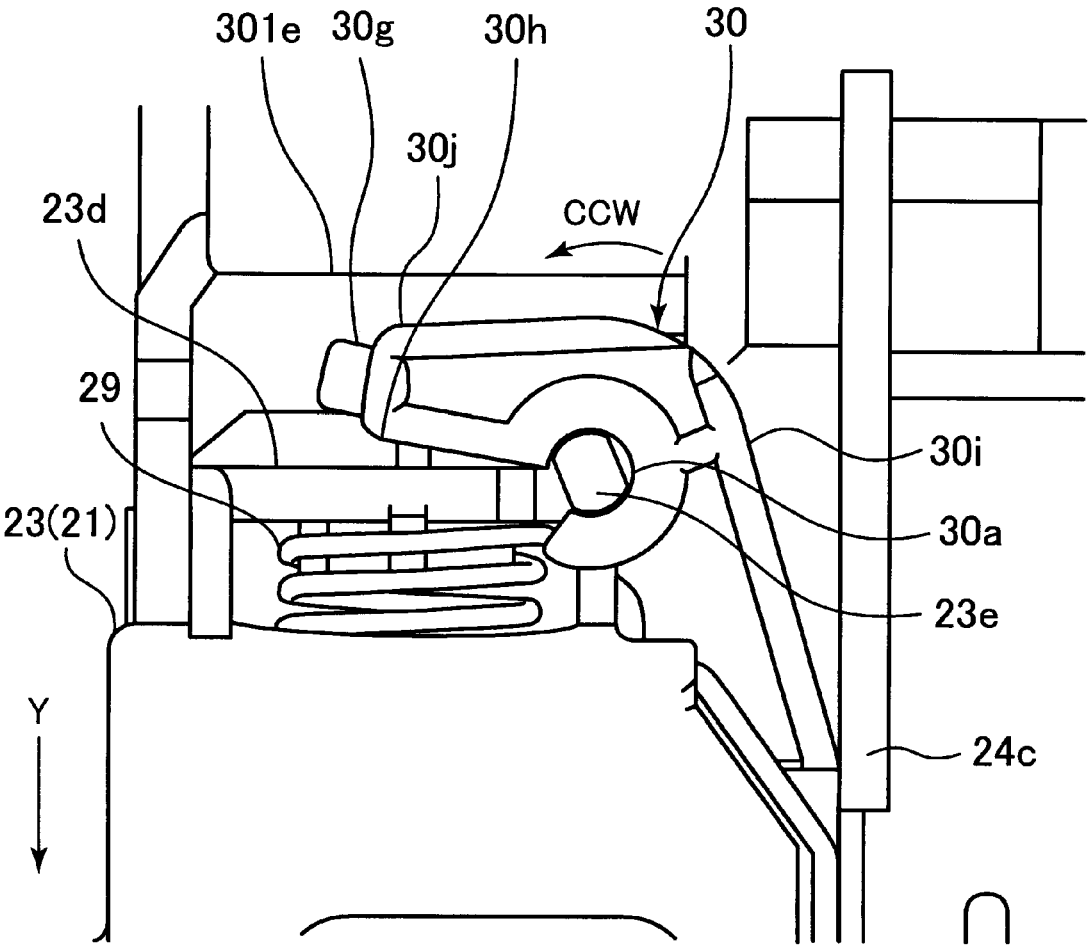

FIG. 13 is a sectional view of the drum cartridge, which is for describing the movement of the locking member, which occurs when the locking member is made to return to its engaging position.

Figure 14:
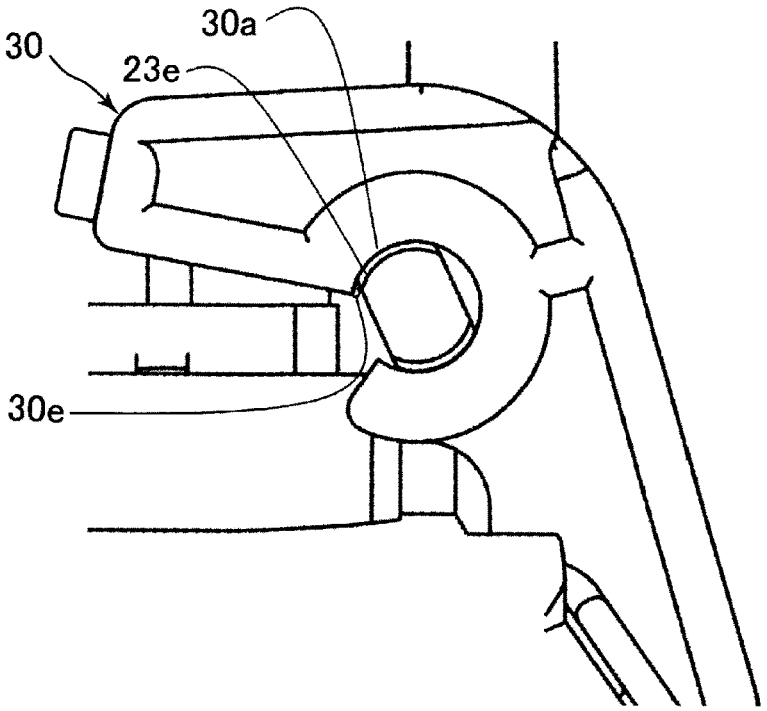

FIG. 14 is a side view of one of the modified version of the locking member in the first embodiment.

Figure 15:
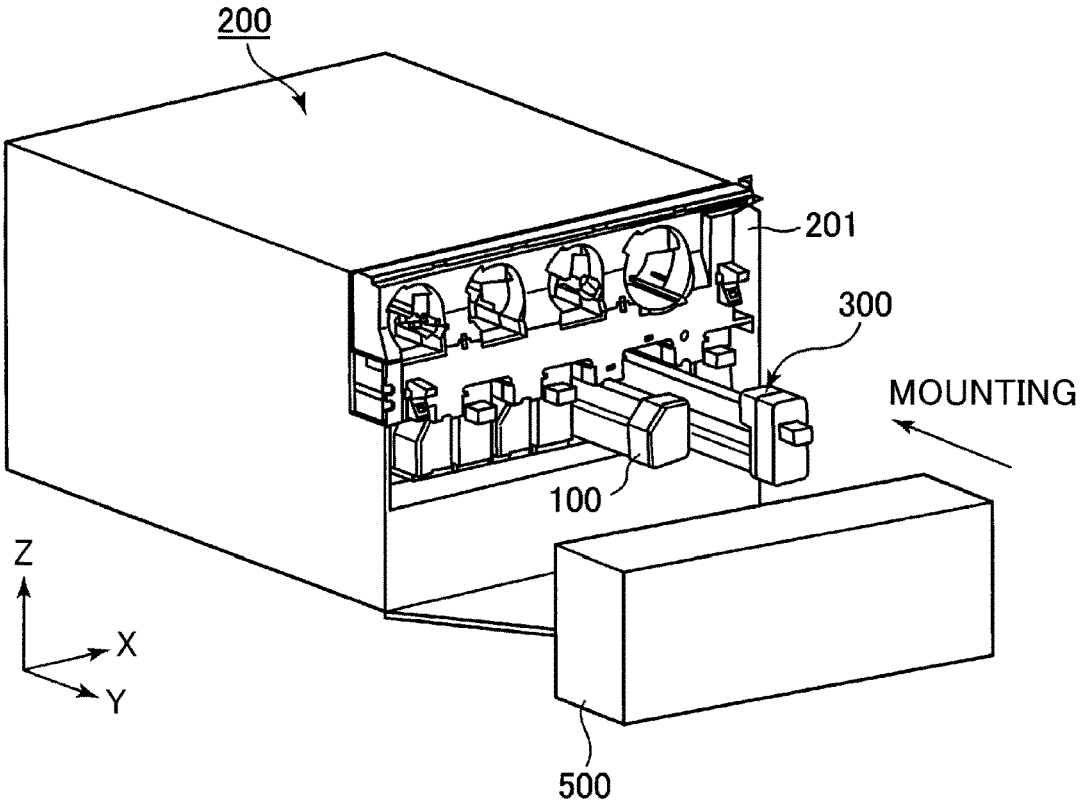

FIG. 15 is a schematic sectional view of another image forming apparatus which is in accordance with the present invention.

Figure 16:
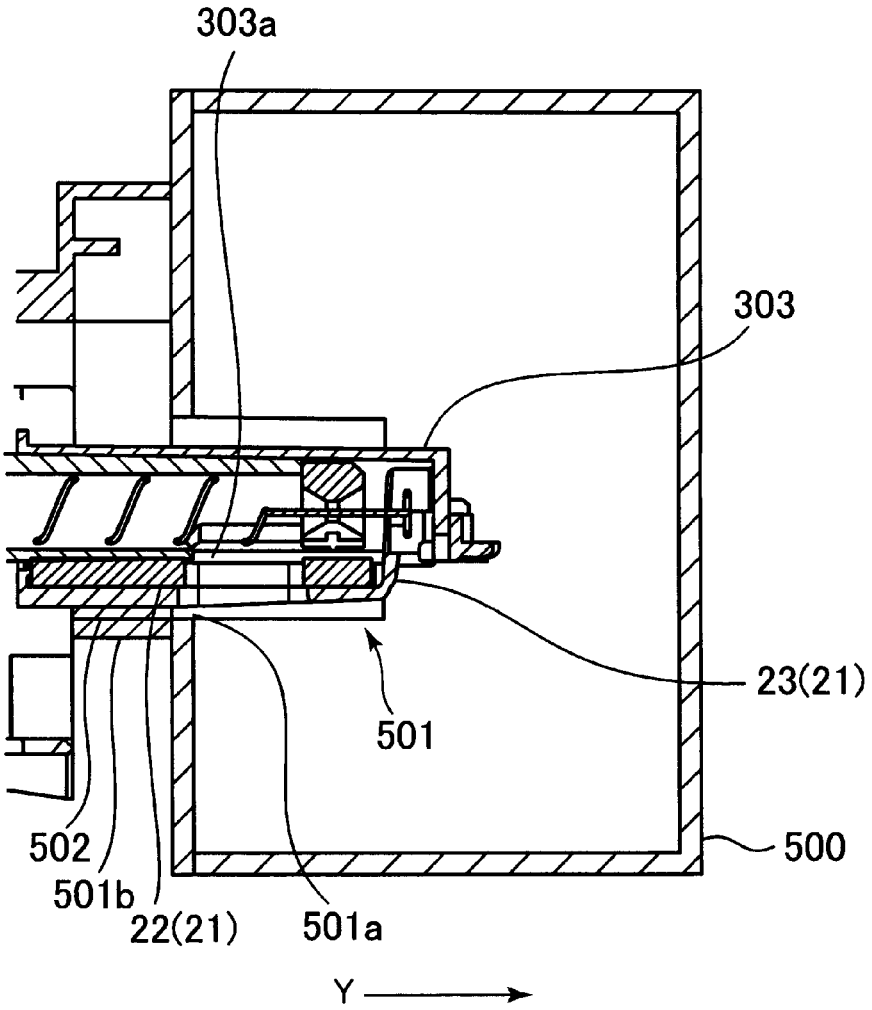

FIG. 16 is a schematic sectional view of the connective portion between the drum cartridge and recovery toner container of the image forming apparatus shown in FIG. 15, and the adjacencies of the connective portion.

Figure 17:
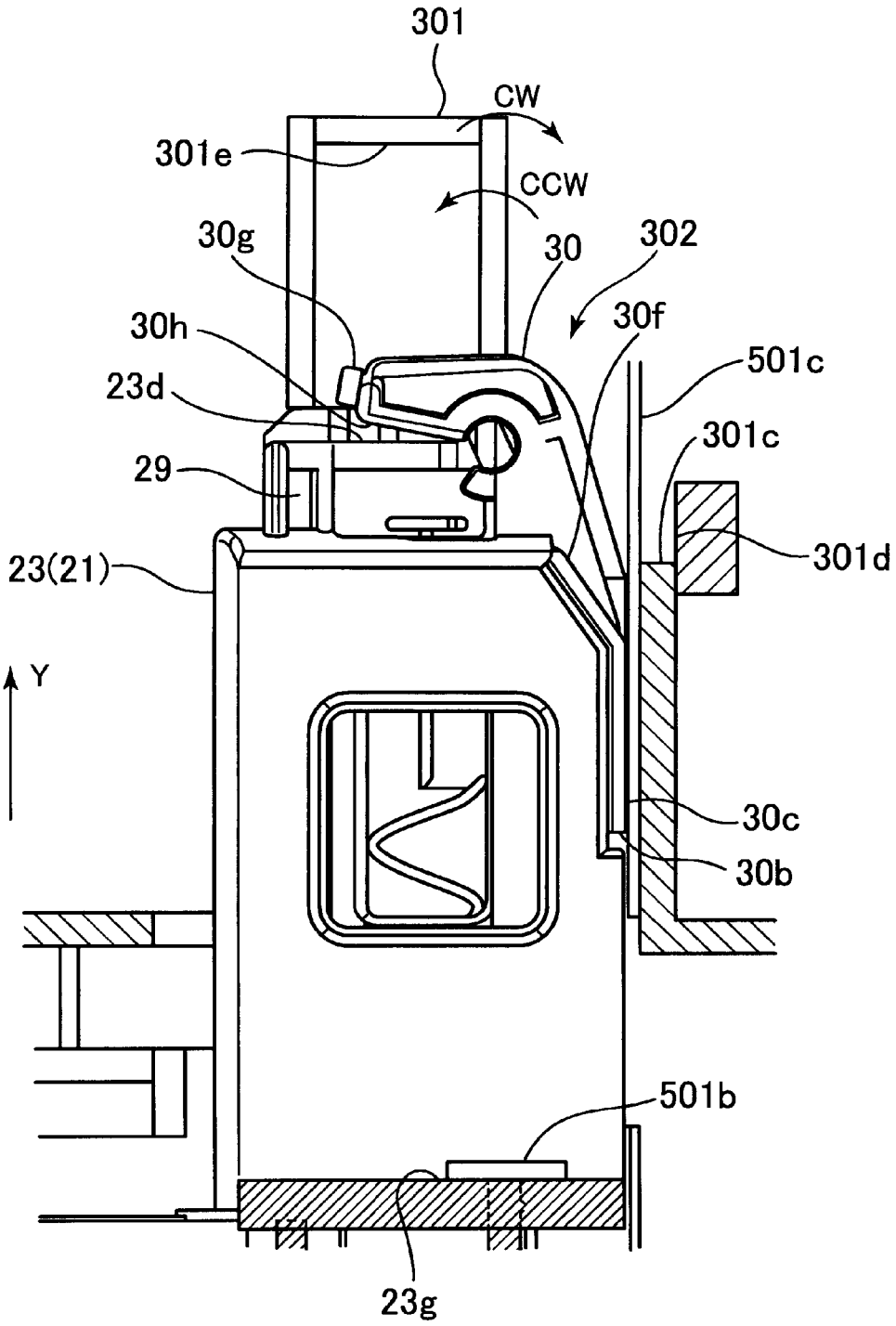

FIG. 17 is a schematic sectional view of the locking mechanism of the image forming apparatus shown in FIG. 15.

DESCRIPTION OF THE EMBODIMENTS

A combination of an image forming apparatus and a removably installable unit for the image forming apparatus, which is in accordance with the present invention is described in greater detail with reference to appended drawings.

Embodiment 1

1. Image Forming Apparatus

Figure 1:
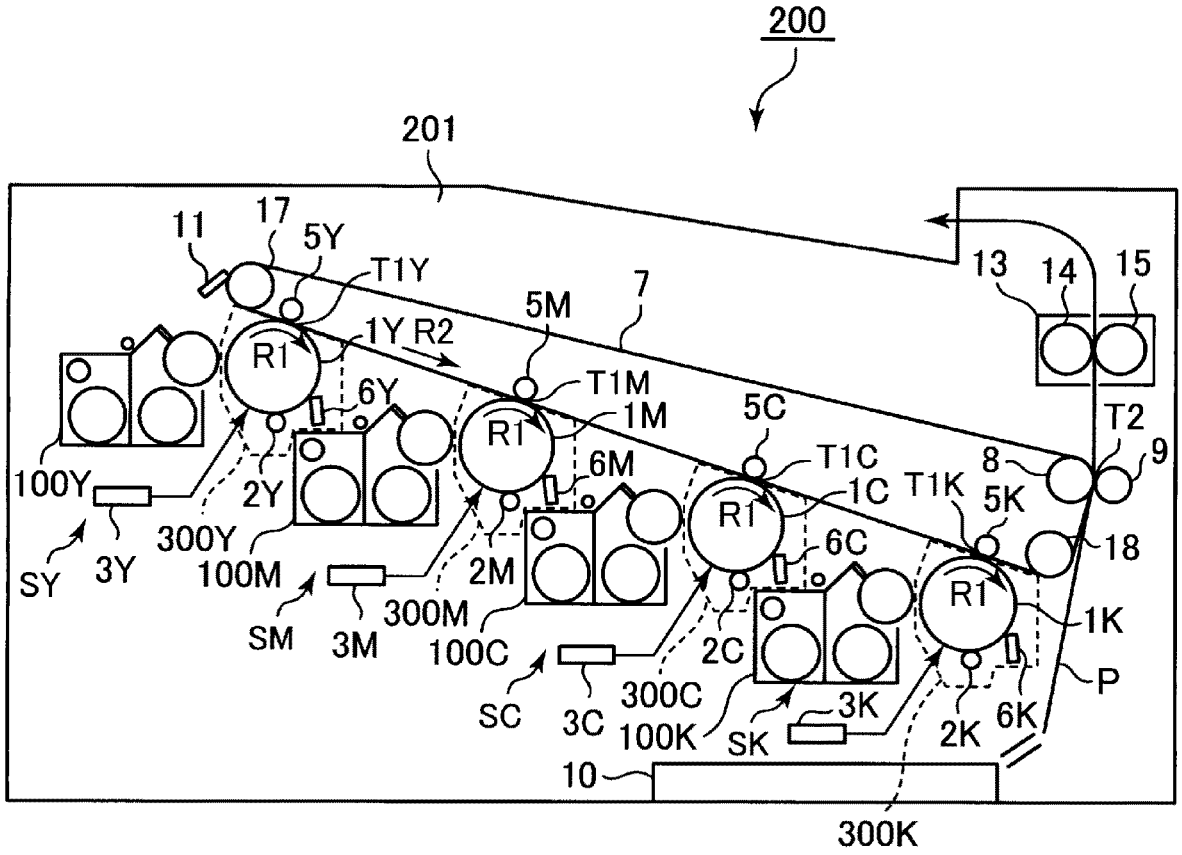
FIG. 1 is a schematic sectional view of a typical image forming apparatus to which the present invention is applicable.

FIG. 1 is a schematic sectional view of the essential portions of the image forming apparatus 200 in this embodiment. The image forming apparatus 200 in this embodiment is a full-color laser beam printer which is capable of forming a full-color image with the use of an electrophotographic method. It is of the so-called intermediary transfer type, and also, of the so-called tandem type. It employs a drum cartridge 300, which is in accordance with the present invention, and is a removably installable unit.

The image forming apparatus 200 has multiple (four) image forming portions (stations) SY, SM, SC and SK, which are for forming yellow (Y), magenta (M), cyan (C) and black (K) images, respectively. The components of the image forming portions SY, SM, SC and SK, which are the same and/or correspondent in function and/or structure, may sometimes be described together without suffixes Y, M, C and K, which indicate which color component they are associated. In this embodiment, each image forming portion S comprises a photosensitive drum 1 (1Y, 1M, 1C or 1K), a charge roller 2 (2Y, 2M, 2C or 2K), an exposing apparatus 3 (3Y, 3M, 3C or 3K), a developing apparatus 100 (100Y, 100M, 100C or 100K), a primary transfer roller 5 (5Y, 5M, 5C or 5K), and a cleaning apparatus 6 (6Y, 6M, 6C or 6K).

The photosensitive drum 1 is an image forming member. It is a photosensitive member (electrophotographic photosensitive member), and is in the form of a drum. It comprises a cylindrical aluminum cylinder, and a photosensitive layer formed on the peripheral surface of the cylindrical member in a manner to cover virtually the entirety of the peripheral surface of the photosensitive drum 1. The photosensitive layer is preset in polarity (negative in this embodiment). The photosensitive drum 1 is rotationally driven at a preset peripheral velocity (process speed) in the direction (clockwise direction) indicated by an arrow mark R1 in the drawing. As the photosensitive drum 1 rotates, its peripheral surface is uniformly charged to preset polarity (negative in this embodiment) and potential level by the charge roller 2, which is a charging member (charging means) in the form of a roller. The charged peripheral surface of the photosensitive drum 1 is scanned (exposed) by an exposing apparatus 3 as an exposing means. As a result, an electrostatic image (electrostatic latent image) is formed on the photosensitive drum 1. The exposing apparatus 3 writes an electrostatic image, which is in accordance with the information of the image to be formed, on the peripheral surface of the photosensitive drum 1, by deflecting a beam of laser light, with its rotational mirror, in such a manner that the beam is projected onto the peripheral surface of the photosensitive drum 1 in a manner to scan the peripheral surface. Then, the electrostatic image formed on the photosensitive drum 1 is developed (into visible image) by the toner supplied by the developing apparatus 100 as a developing means. As a result, a toner image is realized on the photosensitive drum 1. The developing apparatus 100 develops the electrostatic image on the photosensitive drum 1, with the use of two-component developer, which is a mixture of toner (nonmagnetic toner particles) and carrier (magnetic carrier particles). In this embodiment, such toner that is the same in polarity as the one to which the peripheral surface of the photosensitive drum 1 is charged adheres to the portions (image portions) of the peripheral surface of the photosensitive drum 1, which have reduced in potential level (in terms of absolute value) by being exposed after the peripheral surface of the photosensitive drum 1 was uniformly charged (reversal development). Further, the normal polarity of the toner, which is the same as the toner polarity during a developing operation, is negative.

There is disposed in the apparatus main assembly, an intermediary transfer belt 7, as an intermediary transferring member, which is an endless belt. The intermediary transfer belt 7 is suspended and tension by multiple tensioning-suspending rollers (support rollers), which are a belt-backing roller 8, a tension roller 17, and an entrance roller 18, being provided with a preset amount of tension. The intermediary transfer belt 7 is rotated (circularly moves) in the direction (counterclockwise direction) indicated by an arrow mark R2 in the drawing by the rotational driving of the belt-backing roller 8, which doubles as a drive roller. On the inward side of a loop (belt loop) which the intermediary transfer belt 7 forms, multiple primary transfer rollers 5Y, 5M, 5C and 5K, which are the primary transferring means, are disposed in a manner to oppose the photosensitive drums 1Y, 1M, 1C and 1K, respectively. The primary transfer roller 5 forms a primary transferring portion T1, which is the area of contact between the photosensitive drum 1 and intermediary transfer belt 7, by pressing the inward surface of the intermediary transfer belt 7 toward the photosensitive drum 1. The toner image formed on the peripheral surface of the photosensitive drum 1 is transferred (primary transfer) onto the rotating intermediary transfer belt 7 by the function of the primary transfer roller 5, in the primary transferring portion T1, which is the interface between the photosensitive drum 1 and intermediary transfer belt 7. During the primary transfer process, the primary transfer voltage (primary transfer bias), which is DC voltage and is opposite in polarity from the normally charged toner, is applied to the primary transfer roller 5.

The image forming apparatus 1 is provided with a secondary transfer roller 9, which is disposed in such a position that is on the outward side of the belt loop, which the intermediary transfer belt 7 forms. The secondary transfer roller 9 opposes the belt-backing roller 8. It is the secondary transferring means, and is in the form of a roller. It is kept pressed toward the belt-backing roller 8, with the presence of the intermediary transfer belt 7 between itself and the belt-backing roller 8, forming thereby the secondary transferring portion T2, which is the area of contact between the intermediary transfer belt 7 and secondary transfer roller 9. The toner image formed on the intermediary transfer belt 7 is transferred (secondary transfer) onto a sheet P of recording medium such as recording paper, by the function of the secondary transfer roller 9, in the secondary transferring portion T2, while the sheet P is conveyed by being sandwiched by the intermediary transfer belt 7 and secondary transfer roller 9. During the secondary transfer process, the secondary transfer voltage (secondary transfer bias) is applied to the secondary transfer roller 9. The secondary transfer voltage is DC voltage, and is opposite in polarity from the normal toner charge. Sheets P of recording medium are sent out of a recording medium cassette 10 one by one. Then, each sheet P of recording medium is conveyed to the secondary transferring portion T2 with such timing that its arrival at the secondary transferring portion T2 is in synchronism with the arrival of the toner image on the intermediary transfer belt 7 at the secondary transferring portion T2. Each sheet P of recording medium is moved out of the recording medium cassette 10 by a feed roller, and is conveyed to the secondary transferring portion T2 by conveyance rollers, a feeding-conveying apparatus (unshown) having a pair of registration rollers, etc.

After the transfer of a toner image onto a sheet P of recording medium, the sheet P is conveyed to a fixing apparatus 13 as a fixing means. The fixing apparatus 13 fixes (melt toner image, and then, solidly adhere toner image to sheet P) the toner image on the surface of the sheet P, to the surface of the sheet P, by heating and pressing the sheet P. Thereafter, the sheet P is discharged (outputted) out of the main assembly 201 of the image forming apparatus 200.

Meanwhile, the toner (primary transfer residual toner) which failed to be transferred onto the intermediary transfer belt 7 during the primary transfer process, and therefore, is remaining on the photosensitive drum 1, is removed from the photosensitive drum 1, and recovered, by the cleaning apparatus 6 as a means for cleaning the photosensitive drum 1. The cleaning apparatus 6 scrapes away the primary transfer residual toner from the peripheral surface of the rotating photosensitive drum 1, by its cleaning blade as a cleaning member, which is positioned so that it remains in contact with the peripheral surface of the photosensitive drum 1, and stores the recovered toner in its toner storage for the recovered toner. By the way, the cleaning apparatus 6 will be described later in greater detail. On the outward side of the outward surface of the intermediary transfer belt 7, a belt cleaning apparatus 11, as a means for cleaning the intermediary transfer belt 7, is disposed in a position in which it opposes the tension roller 17. As for the toner (secondary transfer residual toner) which failed to be transferred onto a sheet P of recording medium during the secondary transfer process, and therefore, is remaining on the intermediary transfer belt 7, is removed and recovered by the belt cleaning apparatus 11. The belt cleaning apparatus 11 scrapes away, and recovers, the secondary transfer residual toner from the surface of the rotating intermediary transfer belt 7, by its belt cleaning blade, as a cleaning member, which is disposed in a manner to be in contact with the peripheral surface of the intermediary transfer belt 7. The belt cleaning blade is formed of elastic rubber, like a cleaning blade which is described later.

Regarding the image forming portion S in this embodiment, the photosensitive drum 1, charge roller 2, and cleaning apparatus 6 are unitized in the form of a drum cartridge 300 (drum unit). The drum cartridge 300 is removably installable in the apparatus main assembly 201, making it possible for the drum cartridge 300 to be replaced with a brand-new one as the photosensitive drum 1 reaches the end of its service life, for example.

Also regarding the image forming portion S in this embodiment, the developing apparatus 100 is practically in the form of a unit on its own. That is, it is in the form of a development cartridge (development unit), which is removably installable in the apparatus main assembly 201, for maintenance or to be replaced with a brand-new one, for example.

2. Drum Cartridge

Next, the drum cartridge 300 in this embodiment is described further. By the way, in the following description of this embodiment, regarding the orientation of the image forming apparatus 200 and its elements, their portions which correspond in position to the front side of the sheet of paper on which FIG. 1 is, will be referred to as "front" portions; the portions which correspond in position to the rear side, "rear" portions; the left portions as seen from the "front" side, "left" portions; and the right portions as seen from the "front" side will be referred to as "right" side. The front-rear direction of the image forming apparatus 200 is roughly parallel to the rotational axis of the photosensitive drum 1 (which may be referred to as "lengthwise direction"). It is assumed here that such an operation as installation and uninstallation of the drum cartridge 300 and developing apparatus 100 into the image forming apparatus 200, and the uninstallation of the drum cartridge 300 and developing apparatus 100 from the image forming apparatus 200, are performed from the front side of the image forming apparatus 200. Further, the "left" to "right" direction is referred to as "X direction (or +X direction); the "rear" to "front" direction, the "Y direction (or +Y direction); and the "bottom to top" direction, in terms of gravity direction, which is perpendicular to the X and Y directions is referred to as the "Z direction (or +Z direction). Further, the directions which are opposite from the X direction (+X direction), Y direction (+Y direction), and Z direction (+Z direction), one for one, are referred to as "−X", "−Y" and "−Z" directions, respectively. Further, regarding the image forming apparatus 200 and its elements, the direction which is parallel to the lengthwise direction of the photosensitive drum 1 is referred to as "lengthwise direction".

Part (a) of FIG. 2 is an external perspective view of the drum cartridge 300. Part (b) of FIG. 2 is a sectional view (at plane XZ, which is adjacent to the center of photosensitive drum 1 in terms of lengthwise direction) of the drum cartridge 300. The drum cartridge 300 contains the photosensitive drum 1, charge roller 2, and cleaning apparatus 6. It makes it possible for the photosensitive drum 1, charge roller 2, and cleaning apparatus 6 to be installable (mountable) together into the apparatus main assembly 201 or uninstallable (dismountable) together from the apparatus main assembly 201. The cleaning apparatus 6 has a cleaning blade 61 as a cleaning member, and a supporting plate 62 as a supporting member. Further, it has a cleaning container 301, as a frame which functions as an internal recovery toner storage 303 (which hereafter will be referred to simply as "storage"), and a conveyance screw 306 as a toner conveying member disposed in the storage 303. The cleaning blade 61 is fixed to a supporting plate 62 with the use of adhesive. The supporting plate 62 is formed by bending a roughly 2 mm thick metallic plate in such a manner that the cleaning blade 61 appears roughly L-shaped in cross-section at a plane XZ. The cleaning blade 61 is an elastic member, and is formed of urethane rubber, which is an elastic rubbery substance. The cleaning blade 61 has a preset dimension in terms of the lengthwise direction which is roughly parallel to the lengthwise direction of the photosensitive drum 1, and widthwise direction which is roughly perpendicular to the lengthwise direction. It is such a member that looks like a roughly rectangular plate as seen from the direction parallel to the X direction. It is disposed so that one 61*a* of its two edges which are perpendicular to its widthwise direction is placed in contact with the peripheral surface of the photosensitive drum 1 in a manner to generate a preset amount of pressure between itself and the peripheral surface of the photosensitive drum 1. It is fixed to the supporting plate 62 by a part of one of the aforementioned two edges which are perpendicular to the widthwise direction. In this embodiment, a preset amount of contact pressure is obtained between the cleaning blade 61 and the peripheral surface of the photosensitive drum 1, by elastically bending the cleaning blade 61 by pressing the edge portion 61*a* of the cleaning blade 61 against the peripheral surface of the photosensitive drum 1. The cleaning blade 61 is placed in contact with the peripheral surface of the photosensitive drum 1 in the counter direction, that is, such an angle relative to the peripheral surface of the photosensitive drum 1 that the unattached one of its two edges which are perpendicular to the widthwise direction points upstream in terms of the direction in which the peripheral surface of the photosensitive drum 1 moves.

The photosensitive drum 1 is rotatably supported by the cleaning container 301 by its lengthwise end portions. It is a cylindrical member. Its dimension in terms of the lengthwise direction is set according to the size of a sheet P of recording medium which is usable by the image forming apparatus 200, and the size of the image which can be formed by the image forming apparatus 200. For example, in the case of an image forming apparatus (200) which is capable of using a sheet P of recording medium which is A3 in size, the dimension of the photosensitive drum 1 in terms of the lengthwise direction is roughly 400 mm. The cleaning blade 61 has such a length that is similar to the dimension of the photosensitive drum 1 in terms of the lengthwise direction of the photosensitive drum 1, more precisely, such a length that is greater than the dimension of the image formation area of the photosensitive drum 1 in terms of the lengthwise direction (area across which toner can be borne). The toner (primary transfer residual toner) remaining on the peripheral surface of the photosensitive drum 1 after the primary transfer process is recovered from the peripheral surface of the rotating photosensitive drum 1 by the cleaning blade 61.

The toner recovered from the peripheral surface of the photosensitive drum 1 by the cleaning blade 61 is stored in the storage 303. The toner (recovered toner) recovered from the photosensitive drum 1 and stored in the storage 303 is conveyed by the conveyance screw 306, in the storage 303, in the +Y direction, that is, the direction parallel to the lengthwise direction of the photosensitive drum 1. As the toner is conveyed by the conveyance screw 306 in the storage 303, it is discharged out of the cleaning container 301 as it will be described later in detail. In this embodiment, the toner discharged from the storage 303 is stored in a recovery toner container (unillustrated) in the apparatus main assembly 201, through a toner conveyance passage with which the apparatus main assembly 201 is provided. This recovery toner container also is removably installable in the apparatus main assembly 201. As it is filled up with toner, it is replaced with an empty one.

3. Toner Transfer

Next, the toner transfer between the drum cartridge 300 and apparatus main assembly 201 (across joint between drum cartridge 300 and apparatus main assembly 201) is described. FIG. 3 is a sectional view of the joint between the apparatus main assembly 201 and the drum cartridge 300 which is properly positioned in the apparatus main assembly 201, and the adjacencies of the joint (at plane A-A (YZ plane) in part (b) of FIG. 2, which is in the adjacencies of front end of drum cartridge 300).

As described above, the toner in the storage 303 is conveyed in the +Y direction along the lengthwise direction of the photosensitive drum 1 by the conveyance screw 306. There is disposed in the adjacencies of the front end portion of the storage 303 in terms of the lengthwise direction, an intermediary discharge opening 303*a*, which is passable by toner. The toner in the storage 303, that is, the toner conveyed into the storage 303 by the conveyance screw 306, is discharged out of the storage 303 through the intermediary discharge opening 303*a*. On the front end side of the drum cartridge 300 in terms of the lengthwise direction, the cleaning container 301, which functions as the storage 303, is provided with a front cover 20. By the way, in this embodiment, the front cover 20 is fixed to the cleaning container 301 by "snap-fit". However, it may be fixed to the cleaning container 301 by other fixing means such as gluing, welding, or crimping by crimping tool. Further, in this embodiment, the front cover 20 is not an integral part of the cleaning container 301. However, the cleaning container 301 and front cover 20 may be formed as parts of a single member (frame, container). The front cover 20 is provided with an intermediary reception opening 20*a*, which is an opening passable by toner. The intermediary toner reception opening 20*a* is in connection to the intermediary discharge opening 303*a*. As toner is discharged from the intermediary discharge opening 303*a*, it is received by the intermediary toner reception opening 20*a*. Further, the front cover 20 is provided with a toner catching portion, as a connective passage, which is in the form of a piece of pipe. The intermediary toner reception opening 20*a* is at the bottom end portion of the toner catching portion 20*b*.

The drum cartridge 300 is provided with a shutter unit 21 (which may be referred to simply as "shutter", hereafter), which is for opening or closing a discharge opening 20*c* as an opening that makes it possible for toner to move between the inward and outward sides of the drum cartridge 300 (storage 303). The shutter 21 is slidingly movable relative to the front cover 20 (or cleaning container 301). By the way, the structure and operation of the shutter 21 are described later in detail. The shutter 21 has a shutter seal 22 as a sealing member, and a shuttering member 23 as a shutter proper. The shutter seal 22 is fixed to the top surface of the shuttering member 23 in such a manner that it is sandwiched between the front cover 20 and shuttering member 23. By the way, in this embodiment, the shutter seal 22 is fixed to the shuttering member 23 with the use of adhering means such a piece of two-sided adhesive tape. However, it may be fixed with the use of other fixing means such as bonding and welding. The shutter seal 22 prevents toner from leaking between the front cover 20 and shuttering member 23, by being compressed by a preset amount by a compressing surface 20*d*, with which the front cover 20 is provided.

The shutter seal 22 is provided with a shutter seal opening 22*a*, which is an opening passable by toner. As for the shuttering member 23, it is provided with a shutter opening 23*a*, which is an opening passable by toner. Thus, after being conveyed by the conveyance screw 306, the toner is transferred from the intermediary discharge opening 303*a* to the intermediary toner reception opening 20*a*. Then, it free-falls through the downward toner passage 20*b*, goes through the discharge opening 20*c*, shutter seal opening 22*a*, and shutter opening 23*a*, and then, is discharged out of the drum cartridge 300.

The toner discharged out of the drum cartridge 300 is received by the apparatus main assembly 201 side. The apparatus main assembly 201 is provided with an receiving member 24 which makes up one end of the toner conveyance passage, with which the apparatus main assembly 201 is provided, and a receiving member seal 25 as a sealing means. The receiving member 24 is provided with a reception opening 24*a* which is passable by toner. As the shutter opening 23*a* is connected to the reception opening 24*a*, the toner discharged out of the drum cartridge 300 is received by the apparatus main assembly 201 side. The receiving member seal 25 is fixed to the top surface of the receiving member 24 in such a manner that it is sandwiched between the shuttering member 23 and receiving member 24. By the way, in this embodiment, the receiving member seal 25 is fixed to the receiving member 24 by being pasted to the receiving member 24 with the use of a piece of two-sided adhesive tape. However, it may be fixed with the use of other fixing means than a piece of two-sided adhesive tape. For example, it may be fixed by bonding or welding. The receiving member seal 25 prevents toner from leaking between the shuttering member 23 and receiving member 24 by being compressed by a preset amount by a compressing surface 23*b*, with which the shuttering member 23 is provided.

Since the image forming apparatus 200 is structured as described above, the toner recovered from the peripheral surface of the photosensitive drum 1 is discharged out of the drum cartridge 300 by way of the toner conveyance passage of the drum cartridge 300, and then, is received by the receiving member 24 of the apparatus main assembly 201. This completes the toner conveyance from the drum cartridge 300 to the apparatus main assembly 201 side.

4. Installation and Uninstallation of Drum Cartridge

Next, the installation of the drum cartridge 300 into the apparatus main assembly 201, and uninstallation of the drum cartridge 300 from the apparatus main assembly 201, are described. FIG. 4 is a schematic perspective view of the portion of the image forming apparatus 200, in which the drum cartridge 300 is installed into, or uninstalled from, the apparatus main assembly 201, and the adjacencies of this portion. FIG. 5 is a perspective view of a combination of the front and rear plates, and guide rail, of the apparatus main assembly 201. FIG. 6 is a schematic perspective view of the front end portion of a combination of the drum cartridge 300 and a guide rail 28, and the adjacencies of the front end portion. Part (a) of FIG. 6 shows the state of the portions mentioned above, after the installation of the drum cartridge 300. Part (b) of FIG. 6 shows the state of the portions mentioned above, after the removal of the drum cartridge 300.

For example, as the drum cartridge 300 reaches the end of its life expectancy, or in the like case, the drum cartridge 300 which has reached the end of its life expectancy, it is removed from the apparatus main assembly 201, and is replaced by a brand-new one (300). Referring to FIG. 4, in this embodiment, the image forming apparatus 200 is structured so that the drum cartridge 300 can be removed from the apparatus main assembly 201 by an operator such as a service person and a user, by being pulled in the rear-to-front direction (+Y direction), to be replaced by a brand-new one. In this embodiment, the front side of the apparatus main assembly 201 is provided with a door 400, which can be opened or closed to allow the operator to access the interior of the apparatus main assembly 201. The operator can replace the drum cartridge 300 in the apparatus main assembly 201, by opening this door 400.

Referring to FIG. 5, the apparatus main assembly 201 is provided with a front plate 26 and a rear plate 27. The two plates 26 and 27 are positioned so that they are roughly perpendicular to the direction (−Y direction) in which the drum cartridge 300 is inserted into the apparatus main assembly 201, and the direction (+Y direction) in which the drum cartridge 300 is pulled out of the apparatus main assembly 201. Further, the guide rail 28 is disposed between the front plate 26 and rear plates 27 in such a manner that it is squeezed in between the two plates 26 and 27. It is fixed to the front and rear plates 26 and 27 with small screws or the like binding means. By the way, in FIG. 6, only one of the guide rails 28 and corresponding drum cartridge 300 are shown.

Referring to part (a) of FIGS. 6 and 6(*b*), the guide rail 28 is provided with a supporting portion 28*a* and a pair of guiding portions 28*b*. The supporting portion 28*a* is roughly in the form of a rectangular plate, and has an upwardly facing surface. The guide rail 28 is provided with a pair of guiding portions 28*b*, which project upwards from the edges, one for one, of the supporting portion 28*a* in terms of the left-right direction, and extend in the lengthwise direction of the supporting portion 28*a*. That is, the guide rail 28 is such a member that is roughly U-shaped in cross section at an XZ plane. Referring to part (b) of FIG. 6, the supporting portion 28*a* of the guide rail 28 may be provided with an engaging portion 60, which engages with the drum cartridge 300.

The method for installing the drum cartridge 300 into the apparatus main assembly 201 is as follows: First, an operator is to grasp a handle 20*e*, with which the front cover 20 of the drum cartridge 300 is provided, and then, to press the drum cartridge 300 in the front-to-rear direction (−Y direction) of the apparatus main assembly 201 with the use of the handle 20*e*. The method for uninstalling the drum cartridge 300 from the apparatus main assembly 201 is as follows: First, the operator is to grasp the abovementioned handle 20*e*, and then, to pull the drum cartridge 300 in the rear-to-front direction (+Y direction) with the use of the handle 20*e*. When the drum cartridge 300 is inserted into the apparatus main assembly 201, or moved out of the apparatus main assembly 201, the bottom surface 301*b*, with which the cleaning container 301 of the drum cartridge 300 is provided, is supported by the supporting portion 28*a* of the guide rail 28. Further, the guide rail 28 is structured so that its guiding portions 28*b* sandwich the drum cartridge 300 from the left and right sides, with the presence of a minute gap between the drum cartridge 300 and each guiding portion 28*b*. Therefore, when the drum cartridge 300 is installed into the apparatus main assembly 201, or uninstalled from the apparatus main assembly 201, it is regulated in its movement in terms of the direction (+X direction, −X direction) which is roughly perpendicular to the direction in which the drum cartridge 300 is inserted into, or pulled out of, the apparatus main assembly 201.

5. Opening and Closing of Shutter

Next, the opening and closing of the shutter 21, which occur as the drum cartridge 300 is installed or uninstalled is described. FIG. 7 is a sectional view of the front end portion of the drum cartridge 300, and its adjacencies, before the shutter 21 begins to slidingly move, and therefore, the toner conveyance passage between the drum cartridge 300 and apparatus main assembly 201 is remaining blocked, when the drum cartridge 300 is installed into the apparatus main assembly 201. FIG. 8 is a sectional view of the front end portion of the drum cartridge 300, after the shutter 21 began to slidingly move when the drum cartridge 300 is installed into the apparatus main assembly 201. Both FIGS. 7 and 8 are sectional views of the front end portion of the drum cartridge 300 which is similar to the one in FIG. 3, and its adjacencies, at a plane A-A (plane YZ) in part (b) of FIG. 2.

Referring to FIG. 7, the drum cartridge 300 is provided with a pressing spring 29 which is a pressure generating member (pressing member) as a pressure generating means (pressing means), which is between the shuttering member 23 and front cover 20. In this embodiment, the pressing spring 29 generates pressure by being seated in the front seat 20*f*, with which the front cover 20 is provided, by its front end, and the rear seat 23*c*, with which the shuttering member 23 is provided, by its rear end. Before the drum cartridge 300 is installed into the apparatus main assembly 201, the shutter 21 is kept in the downstream end of its range of movement, in terms of the front-to-rear direction (−Y direction) by the function of the pressure generated by the pressing spring 29. Thus, the locking member regulating portion 23*d* of the shuttering member 23 is in contact with the locking member regulating portion 301*e* of the cleaning container 301, with the presence of a locking member 30, between the butting portions 23*d* and 201*e*, keeping the shutter 21 stationary. The pressing spring 29 keeps the shutter 21 pressed from the open position toward the closed position. By the way, this embodiment is not intended to limit the choice of the pressing means to a pressure generating spring. That is, all that is required of the pressing means is to be able to press the shutter 21 in the same direction as the one in this embodiment. For example, a tension spring can be employed by modifying the image forming apparatus in the positioning of the pressing means, and/or where the pressing means is fixed.

When the drum cartridge 300 is in the apparatus main assembly 201, and the front end portion of the drum cartridge 300, and its adjacencies, are in the state shown in FIG. 7, the shutter seal 22 on the shuttering member 23, to which it is pasted is in such a position that it remains compressed by an amount which is equivalent to widths b1 and b2 in FIG. 7, relative to the front cover 20. Therefore, toner is prevented from leaking through the discharge opening 20*c*. In this embodiment, the discharge opening 20*c* has such a rectangular shape that as the discharge opening 20*c* is seen in the +Z direction, it is roughly in the form of a rectangle, the edges of which are parallel to X direction or Y direction (FIG. 9). Further, the shutter seal opening 22*a* also has such a shape that is roughly rectangular, like the discharge opening 20*c* (its dimensions in terms of X and Y direction are slightly greater than the counterparts of the shutter seal opening 22*a*), that is, its edges are parallel to either the X direction or Y direction. The amount of compression which is equal to the width b2 described above is equal to the distance between the front edge of the discharge opening 20*c*, which is parallel to the X direction, and the front edge of the shutter seal 22, which is parallel to the Y direction. Although not illustrated, there is disposed the shutter seal 22 on the outward side of the edge of the discharge opening 20*c*, which is parallel to the Y direction, in such a manner that the shutter seal 22 remains compressed by the preset amount.

The movements of the drum cartridge 300, which occurs when the drum cartridge 300 is installed into the apparatus main assembly 201 is as follows: First, the drum cartridge 300 moves in the front-to-rear direction (−Y direction). Next, the catching portion 23*g*, with which the shuttering member 23 is provided, comes into contact with the bumping portion 24*b*, with which the receiving portion 24 is provided. As the catching portion 23*g* comes into contact with the bumping portion 24*b*, the shutter 21 is positioned relative to the receiving portion 24 as shown in FIG. 8. As the drum cartridge 300 is inserted further toward a preset position in the apparatus main assembly 201, the shutter 21 slidingly moves toward the front cover 20 (or cleaning container 301) in the +Y direction, against the force generated by the compression spring 29.

As the installation of the drum cartridge 300 into the preset position in the apparatus main assembly 201 is completed, the sliding of the shutter 21 toward the front cover 20 (discharge opening 20*c*) ends as shown in FIG. 3. As a result, the discharge opening 20*c*, shutter seal opening 22*a*, and shutter opening 23*a* become connected, providing thereby the tone conveyance passage between the drum cartridge 300 and apparatus main assembly 201.

By the way, the position of the shutter 21, which is shown in FIG. 3, is referred to as "open position" of the shutter 21, in which the discharge opening 20*c* is open, and the toner conveyance passage is provided between the drum cartridge 300 and apparatus main assembly 201. Further, the position of the shutter 21, which is shown in FIG. 7, is referred to as the "closed position" of the shutter 21, in which the shutter 21 keeps the discharge opening 20*c* closed (blocked), and it provides no toner conveyance passage between the drum cartridge 300 and apparatus main assembly 201.

When the drum cartridge 300 is moved out of the apparatus main assembly 201, an opposite sequence from the one described above occurs to move the shutter 21 from the open position to the closed position by the force from the compression spring 29.

6. Locking Mechanism

Next, the locking mechanism for locking the shutter 21, which characterizes this embodiment, is described. The locking mechanism in this embodiment has: a linkage which coordinates the movement (closing) of the shutter 21 relative to the drum cartridge 300, which is caused by the pressure from the compression spring 29, and the rotational movement of the locking member 30 in the direction to lock the shutter 21. Therefore, the locking member 30 can be returned to its engaging position, with no need for additional components. By the way, this embodiment is not intended to limit the present invention in terms of locking mechanism choice. That is, the present invention is compatible with any locking mechanism as long as the locking mechanism can cause the movement of the shutter 21 and drum cartridge 300 relative to each other, and the locking member 30 to rotationally move in the engaging direction, with the utilization of the pressure from the compression spring 29. FIG. 9 is a sectional view of the drum cartridge 300 when the shutter 21 is in the closed position. FIG. 10 is a sectional view of the drum cartridge 300 when the drum cartridge 300 is not in the apparatus main assembly 201. FIG. 11 is a sectional view of the drum cartridge 300 when the shutter 21 is remaining unlocked. FIG. 12 is a sectional view of the drum cartridge 300 when the shutter 21 is in its open potion. FIG. 13 is a sectional view of the locking mechanism 302, which is for showing the operation of the locking mechanism 302, which occurs when the drum cartridge 300 is removed from the apparatus main assembly 201. All of FIGS. 9-13 are sectional views (at XY plane) of the drum cartridge 300 and locking mechanism 302 as seen from the bottom side (direction indicated by arrow mark A in FIG. 3) of the drum cartridge 300. Thus, the direction in which the drum cartridge 300 is inserted into the apparatus main assembly 201 is such a direction that is parallel to the upward direction of the sheets of recording paper on which the drawings are. By the way, in this embodiment, the locking mechanism 302 comprises the locking member 30, first and second lock-regulating portions 301*c* and 301*d*, etc.

Referring to FIG. 9, the shuttering member 23 is provided with the locking member 30, which is attached to the shuttering member 23 so that it can be pivotally moved relative to the shuttering member 23. That is, the shuttering member 23 is provided with a rotational axle 23*e*, which is protrusive in the −Z direction. The rotational axle 23*e* is shaped so that its cross-section is in the form of an arc, across at least a part of it in terms of its lengthwise direction. In this embodiment, the peripheral surface of the axle 23*e* is provided with a pair of flat portions, which are on the opposite side of the axis of the axle 23*e* from each other, and are parallel to each other. On the other hand, the locking member 30 is provided with a cylindrical hole 30*a*. Thus, as the axle of the shuttering member 23 is fitted into the cylindrical hole 30*a* of the locking member 30, the locking member 30 is rotatably supported by the shuttering member 23. Further, in terms of the direction parallel to the rotational axis of the locking member 30, the locking member 30 is supported by the bottom surface 301*b* of the cleaning container 301, and the locking member supporting portion 23*f*, with which the shuttering member 23 is provided, being thereby prevented from disengaging from the shuttering member 23. In this embodiment, each of the shuttering member 23 and locking member 30 is formed of resinous substance (polyacetal resin, for example).

First, the role which the locking mechanism 302 plays when the drum cartridge 300 is out of the apparatus main assembly 201 is described. FIG. 10 shows the state in which the drum cartridge 300 will be if the shutter 21 is moved relative to the front cover 20 (or cleaning container 301), in the direction (+Y direction) to move the shutter 21 from the closed position (FIG. 9) to the open position (FIG. 12), while the drum cartridge 300 is not in the apparatus main assembly 201. Roughly speaking, the locking member 30 has two arms (first and second arms 30*i* and 30*j*). It is shaped as if the arm 30*i* extends from the center of the hole 30*a*, in the different direction from the arm 30*j*, with the presence of a preset angle between the two arms 30*i* and 30*j*. Referring to FIG. 9, an imaginary flat surface I represented by a broken line coincides with the rotational axis of the locking member 30, and is parallel to the YZ plane. In other words, the imaginary flat plane I is parallel to the rotational axis of the locking member 30, and the direction in which the shutter 21 moves. The first arm 30*i* is on the opposite side of this imaginary plane I from the second arm 30*j*. The tip portion of the first arm 30*i* is provided with a first locking portion 30*b* for preventing primarily the shutter 21 from moving relative to the front cover 20 (or cleaning container 301) in the +Y direction. Further, the tip portion of the first arm 30*i* of the locking member 30 is provided with the second locking portion 30*c* for preventing primarily the shutter 21 from rotating in the direction indicated by an arrow mark CCW (counterclockwise direction). On the other hand, the cleaning container 301 is provided with the first lock-regulating portion 301*c*, into which the first locking portion 30*c* of the locking member 30 bumps. Further, the cleaning container 301 is provided with the lock-regulating portion 301*d*, into which the second locking portion 30*c* of the locking member 30 bumps. The first lock-regulating portion 301*c* primarily prevents the shutter 21 from moving relative to the front cover 20 (or cleaning container 301) in the +Y direction. Further, the second lock-regulating portion 301*d* prevents primarily the shutter 21 from rotationally moving in the direction indicated by the arrow mark CCW (counterclockwise direction) in FIG. 10. As the locking member 30 bumps into the cleaning container 301 as described above, it is made to engage by the cleaning container 301, and therefore, the shutter 21 is locked so that it does not open further. During the movement of the shutter 21 described above, the locking member 30 is subjected by the first lock-regulating portion 301*c* to such a moment that is indicated by the arrow mark CCW (counterclockwise direction) in FIG. 10.

At this point in time, referring to FIG. 9, the clearance between the first locking portion 30*b* and first lock-regulating portion 301*c* in terms of the +Y direction is referred to "c1". Further, the distance between the shutter seal opening 22*a* and discharge opening 20*c* in terms of the +Y direction is referred to as "c2". There is the following relationship between c1 and c2.

$$c1<c2.$$

With the above-described relationship between c1 and c2 being satisfied, even if the shutter 21 moves into the position shown in FIG. 10, the discharge opening 20*c* remains sealed by the shutter seal 22. Therefore it is possible to prevent toner from leaking from the discharge opening 20*c*. However, as it will be described later, in order to prevent the problem that when the shutter 21 is unlocked during the installation of the drum cartridge 300, the locking member 30 is prevented from rotationally moving, the clearance c1 needs to be no less than the preset amount.

Further, the locking mechanism 302 is structured so that in whatever attitude the drum cartridge 300 is put, it does not occur that the locking member 30 rotationally moves due to its own weight. That is, for example, let's assume here that an operator tried to open the shutter 21 by mistake as described above, and therefore, the image forming apparatus 200 has changed in state from the one in which locking member 30 is prevented by the pressure from the compression spring 29, from rotationally moving, as described above, into the one in which it is allowed to rotationally move. If the locking member 30 is allowed to rotationally move due to its own weight, it retracts from the position in which it can bump into the cleaning container 301 as described above, making it possible for the shutter 21 to be moved to its open position. This is why the locking mechanism is structured so that in no matter what kind of attitude the drum cartridge 300 is put while the drum cartridge 300 is out of the apparatus main assembly 201, the locking member 30 will not rotationally move due to its own weight. That is, the locking mechanism 302 is structured so that the locking member 30 will not rotationally move, that is, remains stationary, unless the locking member 30 is subjected to the action of a disengaging portion 24*c*, which will be described later, or the rotational force (pressure) from the compression spring 29.

More concretely, regarding the relationship between the axle 23*e* and hole 30*a* in terms of their dimension, in this embodiment, the external diameter (diameter of circumscribed circle, at XY plane) is roughly 30 μm greater than the internal diameter (diameter of inscribed circle at XY plane of the hole 30*a*. In addition, in this embodiment, the axle hole 30*a* of the locking member 30 is not perfectly circular (XY plane); a part 30*d* of it is missing. That is, the locking mechanism 302 is structured so that when the locking member 30 is attached to the shuttering member 23, the locking member 30 is made to deform in such a manner that it gradually increases in the internal diameter of its axle hole 30*a*. Because the locking mechanism is structured as described above, when the locking member 30 is rotationally moved relative to the shuttering member 23, the locking member 30 remains subjected to a preset amount of frictional resistance which occurs between the axle 23*e* and axle hole 30*a*. Therefore, no matter in what kind of attitude (−X direction becomes upward direction, and +X direction becomes downward direction, for example), it does not occur that the locking member 30 is made to rotationally move by its own weight, and unlocks the shutter 21. Therefore, as an operator tries to open the shutter 21 by mistake, the aforementioned frictional resistance prevents the locking member 30 from rotationally moving. Therefore, the shutter 21 is not unlocked.

By the way, this embodiment is not intended to limit the present invention in terms of the structural arrangement for preventing the locking member 30 from rotationally moving. That is, the application of the present invention is not limited to a structural arrangement such as the one in this embodiment, which generates frictional resistance between the axle 23*e* and the wall of the axle hole 30*a*. FIG. 14 shows the adjacencies of the axle hole 30*a* of the locking member 30 in a modified version of this embodiment. For example, the wall of the axle hole 30*a* may be provided with a minute projection 30*e* which is enabled to engage with the axle 23*e* (in adjacencies of missing portion 30*d*, for example). In this case, as the shutter 21 is opened, the minute projection 30*e* catches the axle 23*e*, functioning as the resistance for preventing the locking member 30 from being rotationally moved by its own weight.

Further, in this embodiment, the shuttering member 23 is provided with the axle 23*e*, and the locking member 30 is provided with the axle hole 30*a*. However, it may be the shuttering member 23 and locking member 30 that are provided with an axle hole and axle, respectively. All that is necessary is that the locking member 30 is attached to the shutter 21 in such a manner that the locking member 30 is allowed to rotationally move between its engaging position and disengaging position.

Next, the actions which occur to the locking mechanism 302 when the drum cartridge 300 is installed into the apparatus main assembly 201 are described. Referring to FIG. 11, in this embodiment, the apparatus main assembly 201 is provided with the receiving member 24 which moves relative to the drum cartridge 300 as the drum cartridge 300 is installed into the apparatus main assembly 201. The receiving portion 24 is provided with a disengaging portion 24*c*, which is in the form of a rib. Further, in this embodiment, the first arm portion of the locking member 30 is provided with a release acceptance portion 30*f*, which is also in the form of a rib having a slanted surface. As the drum cartridge 300 is inserted into the apparatus main assembly 201 (in −Y direction), the disengaging portion 24*c* comes into contact with the disengagement acceptance portion 30*f* Thus, the locking member 30 is made to rotationally move in the direction (clockwise direction) indicated by the arrow mark CW in FIG. 11. As a result, the shutter 21 is unlocked. During this action, the locking member 30 rotationally moves, with its first bumping portion 30*g* and second bumping portion 30*h*, which will be described later with reference to FIG. 13, remaining in contact with the bumping portions 301*e* of the drum cartridge 300, and the locking member regulating portion 23*d* of the shutter 21, respectively. Therefore, the locking member 30 causes the shutter 21 to slightly move relative to the front cover 20 (or cleaning container 301) in the +Y direction. Referring to FIG. 11, the direction (indicated by arrow mark CW in FIG. 11) in which the locking member 30 is rotationally moved to be disengaged to unlock the shutter 21 is opposite from the direction (indicated by arrow mark CCW in FIG. 10) in which the locking member 30 is moved to engage to lock the shutter 21. Further, referring to FIG. 11, regarding the +Y direction, the locking mechanism 302 is structured so that it is when there is a clearance c3, which is greater than a preset amount, between the bumping portions 24*b* and receiving portion 23*g*, that the unlocking of the shutter 21 ends. More concretely, the disengaging portion 24*c*, disengagement acceptance portion 30*f*, bumping portion 24*b*, and receiving portion 23*g* are positioned and shaped so that the above-described requirements are satisfied. Therefore, the shutter 21 is unlocked (by locking member 30) before the bumping portion 24*b* and receiving portion 23*g* come into contact with each other, and start moving the shutter 21 to slide toward the open position.

Then, as the drum cartridge 300 is inserted into the apparatus main assembly 201 toward the preset position in the apparatus main assembly 201, the bumping portion 24*b* bumps into the receiving portion 23*g*. Then, while the shutter 21 is moved to its open position as described above, the locking member 30 remains disengaged by disengaging portion 24*c* of the receiving portion 24, and therefore, the shutter 21 remains unlocked.

Further, referring to FIG. 12, even after the completion of the installation of the drum cartridge 300 into the apparatus main assembly 201, the locking member 30 is kept by the disengaging portion 24*c* in a state in which it keeps the shutter 21 unlocked.

By the way, the position in which the locking member 30 is when the drum cartridge 300 is in the state shown in FIG. 10 is referred to as "engaging position" (first position) in which it keeps the shutter 21 locked. Further, the position in which the locking member 30 is when the drum cartridge 300 is in a state shown in FIGS. 11 and 12, is referred to as "disengaging position" (second position) in which the shutter 21 remains unlocked by the locking member 30.

Next, the actions which occur to the locking mechanism 302 when the drum cartridge 300 is uninstalled from the apparatus main assembly 201 is described. Referring to FIG. 13, before the drum cartridge 300 begins to be uninstalled from the apparatus main assembly 201 (in +Y direction), the locking member 30 remains in its disengaging position, in which it has been kept by the disengaging portion 24*c*. By the way, as locking mechanism 302 is changed in state from the one shown in FIG. 2 into the one shown in FIG. 13 while the drum cartridge 300 is uninstalled from the apparatus main assembly 201, the shutter 21 moves relative to the front cover 20 (or cleaning container 301) in the −Y direction, and therefore, the discharge opening 20*c* is closed by the shutter 21 (FIG. 11). Further, during this movement of the shutter 21, the receiving portion 23*g* and bumping portion 24*b* are separated from each other, but, the disengaging portion 24*c* remains in contact with the locking member 30 (FIG. 11).

Next, referring to FIG. 13, the second arm portion 30*j* of the locking member 30 is provided with the first and second areas 30*g* and 30*h* of contact. The first area 30*g* of contact is disposed at the tip of the second arm portion 30*j*, and the second area 30*h* of contact is disposed closer (on downstream side of first area 30*g* of contact in terms of +Y direction) than the first area 30*g* of contact. Thus, as the disengaging portion 24*c* is separated from the locking member 30 by the movement of the drum cartridge 300, the shutter 21 is made to move relative to the front cover 20 (or cleaning container 301) in the −Y direction by the function of the pressure from the compression spring 29. During this movement of the shutter 21, first, the first area 30*g* of contact bumps into the locking member regulating portion 301*e* of the cleaning container 301. Therefore, the locking member 30 rotationally moves from the disengaging position toward the engaging position (indicated by an arrow mark CCW in FIG. 13). Moreover, as the second area 30*h* of contact bumps into the locking member regulating portion 23*d* on the shutter side, the locking member 30 returns to the engaging position (state shown in FIG. 9), and stops. Then, the locking member 30 is sandwiched between the locking member regulating portion 23*d* on the shutter side, and the locking member regulating portion 301*e* on the container side, by the function of the pressure from the compression spring 29, remaining therefore in the engaging position. Because the locking mechanism 302 is structured as described above, it is possible to make the locking member 30 return to the engaging position by the utilization of the pressure from the compression spring 29 for keeping the shutter 21 pressured from the open position toward the closed position, that is, without requiring the addition of a special actuator dedicated to make the locking member 30 return to the engaging position. Therefore, it becomes possible to realize the locking mechanism 302 which is smaller in component count, simpler in structure, and smaller than any conventional locking mechanism.

As described above, in this embodiment, the removably installable unit 300 has: a storing portion 303 for storing powdery substance; the connective portion 20*b* provided with the discharge opening 20*c* for connecting the interior and exterior of the storing portion 303; the shutter 21 which is movable between the open position, in which it keeps the discharge opening 20*c* open, and the closing position, in which it keeps the discharge opening 20*c* closed; the pressing member 29 (compression spring) for keeping the shutter 21 pressured in the open position-to-closed position direction; and the locking member 30 attached to the shutter 21 in such a manner that it is allowed to rotationally move between the first position which prevents the shutter 21 from moving to the open position, and the second position which allows the shutter 21 to move into the closed position. Further, in this embodiment, when the removably installable unit 300 is installed into the apparatus main assembly 201, the locking member 30 is made to rotationally move in the first direction CW, that is, the direction to move from the first position toward the second position, by the disengaging portion 24*c* with which the apparatus main assembly 201 is provided, and which moves relative to the removably installable unit 300, whereas when the removably installable unit 300 is removed from the apparatus main assembly 201, the locking member 30 is made to rotationally move in the second direction CCW, that is, the direction to move from the second position to the first position by the pressure from the pressing member 29 (compression spring). In this embodiment, when the removably installable unit 300 is installed into the apparatus main assembly 201, the shutter 21 is made to move from the open position to the closed position by the bumping portion 24*b* with which the apparatus main assembly 201 is provided, and which moves relative to the removably installable unit 300, whereas when the removably installable unit 300 is removed from the apparatus main assembly 201, the shutter 21 is made to move from the open position to the closed position by the pressure from the pressing member 29 (compression spring). Further, in this embodiment, while the shutter 21 is in the closed position, the locking member 30 remains subjected by the pressure from the pressing member 29, to such force that works in the direction to rotationally move the shutter 21 in the second direction CCW. Further, in this embodiment, as the shutter 21 is made to move toward the open position while the locking member 30 is in the first position, the locking member 30 is subjected to such force that works in the direction to cause the locking member 30 to rotationally move in the second direction CCW, by preventing the shutter 21 from being positioned in the open position. Further, in this embodiment, while the locking member 30 is in the first position, the shutter 21 is in the open position; the shutter 21 is not prevented from being in the open position; and the locking member 30 is kept stationary in the first position. In this embodiment, the locking member 30 is kept in the first position by the friction between the locking member 30 and shutter 21. Further, in this embodiment, as long as the locking member 30 is unaffected by the disengaging portion 24*c* or the pressure from the pressing spring 29, the locking member 30 remains in the first or second position.

As described above, in this embodiment, if an attempt is made to move the shutter 21 in the opening direction while the drum cartridge 300 is out of the apparatus main assembly 201, the shutter 21 remains locked by the locking member 30, being prevented from opening. Further, as the drum cartridge 300 is inserted into the apparatus main assembly 201 to be installed, the locking member 30 bumps into the disengaging portion 24*c*, with which the apparatus main assembly 201 is provided, and therefore, is disengaged by being rotationally moved. Moreover, during the removal of the drum cartridge 300 from the apparatus main assembly 201, the locking member 30 is rotationally moved back into the engaging position, by the resiliency of the compression spring 29 for pressing the shutter 21. Thus, the locking mechanism 302 in this embodiment is substantially smaller in component count, smaller in size, being therefore advantageous in terms of installation into a narrow space, and simple in structure, and yet, can lock the shutter 21 for opening or closing the discharge opening 20*c*, as well as, or better than, any conventional shutter locking mechanism. As described above, according to this embodiment, the removably installable unit 300 can lock the shutter 21 for opening or closing the opening 20*c*; the locking member 30 can be disengaged by the installation of the removably installable unit 300 into the apparatus main assembly 201, and engaged again by the uninstallation of the removably installable unit 300 from the apparatus main assembly 201.

Embodiment 2

Next, another embodiment of the present invention is described. The image forming apparatus in this embodiment is the same in basic structure and operation as the image forming apparatus in the first embodiment. Therefore, the elements of the image forming apparatus in this embodiment, which are the same as, or correspondent to, the counterparts in the first embodiment, in function or structure, are given the same referential codes as those given to the counterparts, and are not described in detail.

In the first embodiment, the image forming apparatus 200 was structured so that as the drum cartridge 300 is installed into the apparatus main assembly 201, the shutter 21 is unlocked and opened by the movement of the drum cartridge 300, whereas as the drum cartridge 300 is uninstalled from the apparatus main assembly 201, the shutter 21 is closed and locked by the movement of the drum cartridge 300. That is, in the first embodiment, as the drum cartridge 300 is inserted into, or extracted from, the apparatus main assembly 201, the disengaging portion 24*c* and bumping portion 24*b*, with which the apparatus main assembly 201 is provided, were moved relative to the drum cartridge 300, in a manner to engage the locking member 30, and move the shutter 21, respectively. However, the locking member 30 and shutter 21 can be made to operate, by providing any component of the apparatus main assembly 201 with the aforementioned disengaging portion and bumping portion, as long as the component moves relative to the drum cartridge 300. In this embodiment, the image forming apparatus 200 is structured so that as the recovery toner container which stores the recovered toner from the photosensitive drum 1, and is removably installable in the apparatus main assembly 201, is installed into, or uninstalled from, the apparatus main assembly 201, the shutter 21 is closed and locked, or unlocked and opened, by the movement of the recovered toner container.

FIG. 15 is a schematic perspective view of the image forming apparatus 200 in this embodiment. It shows how the recovery toner container 500 (recover toner box) is installed or uninstalled. In this embodiment, the image forming apparatus 200 is structured so that the recovery toner container 500, which is removably installable in the apparatus main assembly 201, is installed on the front side of the drum cartridge 300, in the apparatus main assembly 201. For convenience sake, FIG. 15 shows the image forming apparatus 200, one of the drum cartridge 300 of which, and one of the developing apparatus 100 of which, are partially out of the apparatus main assembly 201. However, it is when the drum cartridge 300 and developing apparatus 100 are in the apparatus main assembly 201 that the recovery toner container 500 are installed or uninstalled. The direction in which the recovery toner container 500 is installed into the apparatus main assembly 201 is the −Y direction (installation direction indicated by arrow mark in FIG. 15). The direction in which the recovery toner container 500 is moved out of the apparatus main assembly 201 is the +Y direction. In this embodiment, as the recovery toner container 500 is installed into, or uninstalled from, the apparatus main assembly 201, the shutter 21 with which the drum cartridge 300 is provided, is unlocked, or locked, by the movement of the recovery toner container 500, and therefore, the shutter 21 is allowed to open or close, respectively, by the movement of the recovery toner container 500.

FIG. 16 is a sectional view (at YZ plane) of a combination of the recovery toner container 500 and a part of the drum cartridge 300 when there is a toner conveyance passage between the drum cartridge 300 and recovery toner container 500. Referring to FIG. 16, in this embodiment, the drum cartridge 300 is provided with a shutter 21 (shutter unit), which is positioned so that it can open or close the discharge opening 303*a*, with which the storage portion 303 (recovery toner storage) of the drum cartridge 300 is provided. Like in the first embodiment, the shutter 21 comprises the shuttering member 23, and the shutter seal 22 which is for preventing toner from leaking from the discharge opening 303*a*. On the other hand, the recovery toner container 500 is provided with a toner receiving portion 501, which receives toner (recovery toner) from the drum cartridge 300. The receiving portion 501 is provided with a reception opening 501*a*. Further, the receiving portion 501 is provided with a seal seat 501*b*, to which a receiving portion seal 502 as a sealing member is attached with adhesive. Thus, it is prevented that toner leaks through the gap between the cleaning container 301 of the drum cartridge 300, and the recovery toner container 500.

FIG. 17 is a schematic sectional view (at XY plane) of the shutter 21 and its adjacencies, as seen from underneath, when the shutter 21 is in its open position. The shutter 21 in this embodiment is basically the same as, or correspondent to, the one in the first embodiment, in structure and operation. In this embodiment, however, as the recovery toner container 500 is installed into, or uninstalled from, the apparatus main assembly 201 while the drum cartridge 300 is in the apparatus main assembly 201, the disengaging portion 501*c* and bumping portion 501*b*, with which the recovery toner container 500 is provided, move relative to the drum cartridge 300. Thus, as the recovery toner container 500 is installed or uninstalled, the disengaging portion 501*c* and bumping portion 501*b* move the locking member 30 and shutter 21, respectively.

Next, the mechanism for locking (or unlocking) the shutter 21, and the action of the sheet feeder cassette 2, in this embodiment, are described further. Referring to FIG. 17, as an operator moves the recovery toner container 500 in the −Y direction to install the recovery toner container 500 into the apparatus main assembly 201, the disengaging portion 501*c*, with which the recovery toner container 500 is provided, comes into contact with the disengagement accepting portion 30*f* of the locking member 30. Consequently, the locking member 30 is rotationally moved in the clockwise direction in FIG. 17. Thus, the locking member 30 is disengaged. That is, the shutter 21 is unlocked. Further, as the operator inserts the recovery toner container 500 into the apparatus main assembly 201 in the −Y direction to install the recovery toner container 500 into the apparatus main assembly 201, the lock disengaging portion 501*b*, with the recovery toner container 500 is provided, comes into contact with the disengagement accepting portion 23*g* of the shutter 21. Thus, the shutter 21 is slidingly moved in the −Y direction relative to the cleaning container 301, to its open position. That is, the actions of the cleaning container 301 and shutter 21 in this embodiment are practically the same as those of the cleaning container 301 and shutter 21 in the first embodiment, except that the direction in which the shutter 21 moves relative to the cleaning container 301 in this embodiment is opposite (−Y direction) from the one in the first embodiment. Also in this embodiment, c1, c2 and c3 mentioned in the description of the first embodiment have only to be set in the similar manner to the one in the first embodiment.

Further, this embodiment is practically the same as the first embodiment, also in the actions of the locking mechanism 302 and the movement of the shutter 21, which occur when the recovery toner container 500 is moved in the +Y direction to remove the recovery toner container 500 from the apparatus main assembly 201, except that in this embodiment, the direction in which the shutter 21 is moved relative to the cleaning container 301 is opposite (−Y direction) from the one in the first embodiment. That is, as the disengaging portion 501*c* is separated from the locking member 30, the shutter 21 is made to slidingly move relative to the cleaning container 301 in the +Y direction by the function of the pressure from the compression spring 29 which keeps the shutter 21 pressured in the direction to move from the open position to closed position. As the shutter 21 is slidingly moved in the +Y direction, first, the first contacting portion 30*g* of the locking member 30 bumps into the locking member regulating portion 301*e* of the cleaning container 301. Thus, the locking member 30 is moved in the direction to move from the disengagement position to the engagement position (counterclockwise direction) indicated by arrow mark CCW in FIG. 17). Moreover, as the second contacting portion 30*h* of the locking member 30 bumps into the locking member regulating portion 23*d* of the shuttering member 23, and therefore, the locking member 30 is moved backed into the engaging position, and stops.

Then, as the locking member 30 returns to the engaging position, the shutter 21 is locked by the locking mechanism 302. Thus, even if an operator tries to move the shutter 21 in the opening direction, the shutter 21 does not open. That is, the first and second locking portions 30*b* and 30*c*, respectively, of the locking member 30 bump into the first and second lock regulating portion of the cleaning container 301, respectively, whereby the shutter 21 is regulated in its movement, remaining therefore locked.

As described above, in this embodiment, when one of the removably installable units 500 is installed into the apparatus main assembly 201 while another removably installable unit 300 is in the apparatus main assembly 201, the locking member 30 is rotationally moved by the disengaging portion 501*c* of another removably installable unit 500, which moves relative to the removably installable unit 300, in the first direction CW, that is, the direction to move from the first position to the second position, whereas when the second removably installable unit 500 is pulled out of the apparatus main assembly 201, the locking member 30 is made to rotationally move by the pressure from the pressing spring 29 (compression spring) in the second direction CCW, that is, the direction to move from the second position to the first position. Also in this embodiment, when first removably installable unit 500 is installed into the apparatus main assembly 201 while the removably installable unit 300 is in the apparatus main assembly 201, the shutter 21 is made to move from the closed position to the open position by the contacting portion 501*b*, with which the first removably installable unit 500 is provided, and which moves relative to the removably installable unit 300, whereas when the first removably installable unit 500 is moved out of the apparatus main assembly 201, the shutter 21 is made to move from the open position to the closed position by the pressure from the pressing spring 29 (compression spring).

As described above, in this embodiment, the engaging/disengaging of the lock, and the opening and closing of the shutter, are caused by the installation and uninstallation of the recovery toner container 500, which is removably installable in the apparatus main assembly 201 and is different from the drum cartridge 300. This structural arrangement for an image forming apparatus also can provide similar effects to those obtainable by the one in the first embodiment.

OTHERS

In the preceding sections, the present invention was concretely described with reference to the embodiments of the present invention. However, these embodiments are not intended to limit the present invention in scope.

In the embodiments described above, a unit which is removably installable in the main assembly of an image forming apparatus was a drum cartridge. However, these embodiments are not intended to limit the present invention in scope in terms of the choices of a removably installable unit to which the present invention is compatible. For example, the present invention is also compatible with a removably installable unit which comprises both a drum cartridge and a developing apparatus, or a unit which comprises only a developing apparatus. For example, some developing apparatuses are structured so that as they are supplied with replenishment developer which includes toner and carrier, the excessive amount of developer (mostly, carrier) in the developing apparatus is discharged from their opening little by little. In the case of these developing apparatuses, the present invention is applicable to the opening of the developing apparatuses as a removably installable unit, and the shutter for opening or closing the opening. Further, the compatibility of the present invention is not limited to a removably installable unit, the opening of which faces downward as the one in the first embodiment; the present invention is also compatible with a removably installable unit, the opening of which faces upward. In the case of a removably installable unit, the opening of which faces upward, its shutter and shutter locking mechanism have only to be positioned on the top side of the opening. For example, the present invention is also applicable to recovery toner unit such as the one in the second embodiment described above. In the case of a recovery toner container, its opening may face upward, and its shutter and shutter locking mechanism have only to be positioned on the top side of the opening.

Further, in the embodiments described above, the image forming apparatus was a color image forming apparatus of the so-called tandem type. However, the compatibility of the present invention is not limited to a color image forming apparatus of the tandem type. For example, the present invention is also compatible with a monochromatic image forming apparatus. By the way, an electrophotographic image forming apparatus to which the present invention is compatible includes an electrophotographic copying machine, an electrophotographic printer, an electrophotographic facsimileing machine, an electrophotographic word processor, and the likes.

According to the present invention, it is possible to provide a removably installable unit, the shutter of which for opening or closing its opening can be locked, and the lock of which can be disengaged or engaged by the unit movement which occurs when the unit is installed or uninstalled, and also, it is possible to provide an image forming apparatus which employs a removably installable unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-190612 filed on Oct. 17, 2019, which is hereby incorporated by reference herein in its entirety.

What is claimed is:

1. A cartridge detachably mountable to a main assembly of an image forming apparatus, the cartridge comprising:

an image bearing member configured to bear a toner image;

a cleaning member configured to remove residual toner from the image bearing member;

a cleaner container including accommodating portion configured to accommodate the toner removed by the cleaning member;

a discharge opening configured to discharge the toner accommodated in the accommodating portion;

a shutter movable between a closed position for closing the discharge opening and an open position for opening the discharge opening;

an urging member configured to urge the shutter to the closed position, wherein when the cartridge is mounted to the main assembly of the image forming apparatus, the shutter abuts to a shutter abutting portion provided in the main assembly of the image forming apparatus to be moved from the closed position to the open position;

a locking member rotatable between a locked position for preventing the shutter from moving from the closed position to the open position and a release position for releasing the shutter from the lock, wherein before the shutter is brought into contact to the shutter abutting portion with a mounting operation of the cartridge to the main assembly of the image forming apparatus, the locking member contacts a releasing portion provided in the main assembly of the image forming apparatus to be rotated in a direction of releasing the lock, by the releasing portion; and an interrelating mechanism configured to interrelate relative movement between the shutter and the cleaner container by an urging force of the urging member and rotation of the locking member in a direction of the lock.

2. A cartridge according to claim 1, wherein the locking member includes a first arm portion configured to contact the releasing portion to be rotated in a direction of releasing when the cartridge is mounted to the main assembly of the image forming apparatus, and the interrelating mechanism includes a second arm provided on the locking member, the second arm portion being disposed on a side opposite from the first arm portion with respect to a plane passing through a rotational center of the locking member, parallel with a rotational axis of the locking member and parallel with a moving direction of the shutter, wherein the second arm portion is provided with a contact portion configured to contact a container side abutting portion provided on the cleaner container, and wherein the locking member is rotated in the locking direction by the shutter being moved toward the closed position by the urging force of the urging member in a state that the contact portion is in contact with the cleaner container.

3. A cartridge according to claim 2, wherein when the shutter is moved toward the open position in a state that the locking member is in the locked position, the first arm portion contacts a first abutting portion provided on the cleaner container to restrict the shutter from an opening and applies a force for rotating from the first abutting portion in a direction opposite from the releasing direction.

4. A cartridge according to claim 2, wherein when the cartridge is mounted in the main assembly of the image forming apparatus, and when the cartridge is removed from the main assembly of the image forming apparatus, the first arm portion does not receive a force from the urging member.

5. A cartridge according to claim 4, wherein the locking member is provided with a restricting portion configured to restrict rotation of the locking member by contacting the shutter when the locking member rotates from the releasing position to the locked position.

6. A cartridge according to claim 4, wherein the locking member or the shutter is provided with a rotational shaft configured to rotate the locking member relative to the shutter, and the other of the locking member and the shutter is provided with an engaging portion rotatably supporting the rotational shaft, and wherein the rotational shaft has an outer diameter larger than an inner diameter of the engaging portion.

7. A cartridge according to claim 1, wherein the locking member is provided with a restricting portion configured to restrict rotation of the locking member by contacting the shutter when the locking member rotates in the locking direction.

8. A cartridge according to claim 1, wherein the locking member or the shutter is provided with a rotational shaft configured to rotate the locking member relative to staid the shutter, and the other of the locking member and the shutter is provided with an engaging portion rotatably supporting the rotational shaft, and wherein the rotational shaft has an outer diameter larger than an inner diameter of the engaging portion.

9. A cartridge according to claim 1, wherein when the locking member receives the force for rotating from the locked position in a direction opposite from the releasing direction, the locking member contacts a second abutting portion provided on the cleaning container to restrict rotation of the locking member.

10. An image forming apparatus comprising a cartridge according to claim 1.

11. A cartridge detachably mountable to a main assembly of an image forming apparatus, the cartridge comprising:

an image bearing member configured to bear a toner image;

a cleaning member configured to remove residual toner from the image bearing member;

a cleaner container including accommodating portion configured to accommodate the toner removed by the cleaning member;

a discharge opening configured to discharge the toner accommodated in the accommodating portion;

a shutter movable between a closed position for closing the discharge opening and an open position for opening the discharge opening;

an urging member configured to urge the shutter to the closed position, wherein a mounting and dismounting unit is detachably mountable the main assembly of the image forming apparatus in a state that the cartridge is mounted in the main assembly of the image forming apparatus, and the shutter abuts to a shutter abutting portion provided on the mounting and dismounting unit to be moved from the closed position to the open position;

a locking member rotatable between a locked position for preventing the shutter from moving from the closed position to the open position and a release position for releasing the shutter from the lock, wherein before the shutter is brought into contact to the shutter abutting portion with a mounting operation of the mounting and dismounting unit to the main assembly of the apparatus, the locking member contacts a releasing portion provided in the mounting and dismounting unit to be rotated in a direction of releasing the lock, by the releasing portion; and an interrelating mechanism configured to interrelate relative movement between the shutter by an urging force of the urging member and the cleaner container and rotation of the locking member in a direction of the lock.

12. A cartridge according to claim 11, wherein the locking member includes a first arm portion configured to contact the releasing portion when the mounting and dismounting unit is mounted to the main assembly of the image forming apparatus to be rotated in the direction of the releasing when the mounting and dismounting unit is mounted to the main assembly of the image forming apparatus, and the interrelating mechanism includes a second arm portion provided on the locking member, the second arm portion being disposed on a side opposite from the first arm portion with respect to a plane passing through a rotational center of the locking member, parallel with a rotational axis of the locking member and parallel with a moving direction of the shutter, wherein the second arm portion is provided with a contact portion contacting a side provided on the cleaner container, and wherein the locking member is rotated in the locking direction by the shutter being moved toward the closed position by the urging force of the urging member in a state that the contact portion is in contact with the cleaner container.

13. A cartridge according to claim 12, wherein when the shutter is moved toward the open position in a state that the locking member is in the locked position, the first arm portion contacts a first abutting portion provided on the cleaner container to restrict the shutter from an opening and applies a force for rotating from the first abutting portion in a direction opposite from the releasing direction.

14. A cartridge according to claim 12, wherein when the cartridge is mounted in the main assembly of the image forming apparatus, and when the cartridge is removed from the main assembly of the image forming apparatus, the first arm portion does not receive a force from the urging member.

15. A cartridge according to claim 11, wherein when the locking member receives the force for rotating from the locked position in a direction opposite from the releasing direction, the locking member contacts a second abutting portion provided on the cleaning container to restrict rotation of the locking member.

16. A cartridge according to claim 11, wherein the mounting and dismounting unit is a toner accommodating container configured to accommodate the toner discharged through the discharge opening.

* * * * *